US005798772A

United States Patent [19]

Tachihara et al.

[11] Patent Number: 5,798,772

[45] Date of Patent: Aug. 25, 1998

[54] DRIVING METHOD INK JET HEAD

[75] Inventors: Masayoshi Tachihara, Chofu; Yasuyuki Tamura, Yokohama, both of Japan

[73] Assignee: Canon Kabushiki Kaisha, Tokyo, Japan

[21] Appl. No.: 848,722

[22] Filed: May 19, 1997

Related U.S. Application Data

[63] Continuation of Ser. No. 97,623, Jul. 27, 1993, abandoned, which is a continuation of Ser. No. 715,769, Jun. 14, 1991, abandoned.

[30] Foreign Application Priority Data

Jun. 15, 1990 [JP] Japan ..... 2-157256

[51] Int. Cl.[6] ..... B41J 2/05

[52] U.S. Cl. ..... 347/11; 347/12; 347/13; 347/57

[58] Field of Search ..... 346/1.1, 140 R; 347/12, 13, 17, 10, 11, 57, 60, 180, 211; B41J 2/05

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,660,056 | 4/1987 | Yokoi | 346/140 R |
| 4,712,172 | 12/1987 | Kiyohara et al. | 346/1.1 |
| 4,719,472 | 1/1988 | Arakawa | 346/140 R |
| 4,723,129 | 2/1988 | Endo et al. | 346/1.1 |
| 4,740,796 | 4/1988 | Endo et al. | 346/1.1 |
| 4,791,453 | 12/1988 | Koseki et al. | 355/14 R |
| 4,860,034 | 8/1989 | Watanabe et al. | 346/140 R |
| 4,947,194 | 8/1990 | Kyoshima | 346/140 R |
| 5,075,698 | 12/1991 | Aoki et al. | 346/1.1 |
| 5,107,276 | 4/1992 | Kneezel et al. | 346/1.1 |
| 5,172,134 | 12/1992 | Kishida et al. | 346/1.1 |

FOREIGN PATENT DOCUMENTS

| | | |
|---|---|---|
| 390202 | 10/1990 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 60-248357 | 12/1985 | Japan . |
| 61-112664 | 5/1986 | Japan . |
| 61-146550 | 7/1986 | Japan . |
| 61-189948 | 8/1986 | Japan . |
| 61-249763 | 11/1986 | Japan . |
| 62-220345 | 9/1987 | Japan . |
| 63-116857 | 5/1988 | Japan . |
| 63-134249 | 6/1988 | Japan . |
| 1-127361 | 5/1989 | Japan . |
| 1-133748 | 5/1989 | Japan . |
| 1-184416 | 7/1989 | Japan . |
| 3-043254 | 2/1991 | Japan . |

*Primary Examiner*—Huan H. Tran

*Attorney, Agent, or Firm*—Fitzpatrick, Cella, Harper & Scinto

[57] ABSTRACT

There is provided a driving method for an ink jet head comprising one or more discharge ports for discharging the ink, a substrate incorporating one or more heat generating elements for generating the heat energy, each of which is provided correspondent to each discharge port, and a support plate or casing on which the substrate is mounted. The method is characterized in that when recording an image with the ink jet head in which the heat energy for discharging the ink in accordance with an image signal is generated in the heat generating elements, and the thermal resistance value passing through said support plate or casing is lower than that not passing through the support plate or casing among the thermal resistance between the substrate and externally of the apparatus $(E_{max}-E)/(V_{max}-V)$ is controlled to be always substantially constant whenever $E \neq E_{max}$, providing that the thermal energy generated in the substrate is $E_{max}$ when the ink jet head discharges the ink with a maximum volume of $V_{max}$, the ink discharge volume in accordance with the image signal is V, and the heat energy generated in the substrate at this time is E.

51 Claims, 21 Drawing Sheets

DRIVING METHOD INK JET HEAD

This application is a continuation of application Ser. No. 08/097,623, filed Jun. 27, 1993, which was a continuation of application Ser. No. 07/715,769, filed Jun. 14, 1991, both now abandoned.

BACKGROUND OF THE INVENTION

1. Field of the Invention

The present invention relates to a driving method for an ink jet head for recording onto a recording medium by discharging the ink in accordance with image signals.

2. Related Background Art

A recording apparatus such as a printer, copying machine or facsimile terminal equipment is constituted to record an image composed of dot patterns onto a recording medium such as paper or plastic thin film.

Recording apparatuses can be classified into those of ink jet, wire dot, thermal and laser beam type, based on the recording method, in which the ink jet method (ink jet recording apparatus) is constituted to record by discharging fine ink (recording liquid) droplets through discharge ports of ink jet head to deposit them onto recording medium.

The ink jet head (recording head) mounted on the ink jet recording apparatus uses either electro-thermal converters or electromechanical transducers as the discharge energy generating element.

The ink jet method in which the ink is discharged by use of the heat energy generated by electro-thermal converters (heat generating elements) is a well-known art as described in U.S. Pat. No. 4,723,129 and U.S. Pat. No. 4,740,796, having several advantages such as the good response characteristic to image signal, miniaturization by allocation of highly densified discharge ports, easy recording of color images, and low noise during recording.

Among them, the on-demand type is widely used because it can easily implement the multi-nozzle, and no operation for waste ink is necessary.

FIG. 22 is a typical exploded perspective view exemplifying a typical structure of an ink jet head using the heat energy. In FIG. 22, 101 is a silicone (Si) substrate, 102 are a plurality of heat generating elements for discharge (electro-thermal converters) incorporated into the substrate, 103 is a discharge port provided corresponding to each of the heat generating elements, 104 is a liquid channel in which each of the heat generating elements is disposed, 105 is a ceiling plate of glass which forms a ceiling of liquid channels 104, and 106 is a support plate made of Al to which the substrate 101 is attached by using adhesive.

The ink is in contact directly with the heat generating elements 102, or with the support plate 106 via a thin protecting film of less than several μm.

In FIG. 22, the arrangement density of the heat generating elements 102 may depend on the recording density, but is normally about 3 to 30 /mm.

In order to attain a practical recording speed using such an ink jet head, pulsed electrical energy for driving is given to each of the heat generating elements 102 in accordance with image signals of several hundreds to several millions times per second. With the electrical energy, each heat generating element is heated, so that air bubbles are produced in the ink within the liquid channels 104. With the pressure of the air bubbles, the ink is discharged through the discharge ports 103 to record images onto a record surface of recording medium, not shown.

In recording with the ink jet head, the heat generated by the heat generating elements 102 is not completely used up, so that residual heat is accumulated. The amount of heat energy generated by the ink jet head is varied with the number of image signals.

Moreover, the ink jet head having a plurality of heat generating elements is likely to have uneven distribution of generated heat in a direction of array of heat generating elements, due to a certain pattern of image signals.

The heat accumulation, variation of heating value, and uneven distribution of heating value may cause some fluctuation or non-uniformity in head temperature.

As the ink temperature rise, which is due to elevation of the head temperature, increases the discharge volume of ink, the ink jet head by the use of the heat energy may cause the increase of image density. Accordingly, the heat accumulation, variation of temperature and uneven distribution of temperature for the head may appear as fluctuations or irregularities in the image density.

Further, the external temperature will also vary the whole image density up and down.

These phenomena may degrade the quality of recording or image, or cause some problems in reproducing the image.

To resolve such problems, means for maintaining the head temperature uniform and/or constant has conventionally been proposed in which temperature detecting means is provided within a head to turn on/off auxiliary heating means in accordance with detected temperature, as described in U.S. Pat. No. 4,719,472, Japanese Laid-Open Patent Application No. 1-133748, Japanese Laid-Open Patent Application No. 63-116875 and Japanese Patent Application No. 1-184416.

U.S. Pat. No. 4,719,472 has disclosed a head constitution in which a temperature sensor and a heater for heating are disposed within an ink reservoir.

Japanese Laid-Open Patent Application No. 1-133748 has disclosed a method for controlling so as not to produce the temperature gradient of recording liquid by turning on/off heating means based on the temperature information from both a temperature sensor provided within a common liquid chamber and a temperature sensor provided at an inlet portion of the common liquid chamber.

Japanese Laid-Open Patent Application No. 63-116857 has disclosed a head having temperature detecting means provided within each of the liquid channels, apart from heat generating elements, for discharging the ink.

Also, Japanese Patent Application No. 1-184416 has disclosed a substrate incorporating a temperature sensor for detecting the temperature of the substrate. Further, the same application has disclosed an ink jet head in which heating means for heating the head is provided, in addition to heat generating elements for discharge, and control means is provided for driving optionally the heat generating elements so as to generate the heat enough not to cause the discharge of ink, as well as compensating for the temperature distribution of the head with such heating.

As to the method of using auxiliary heating means, Japanese Laid-Open Patent Application No. 61-146550 has proposed heating control means for heating the ink by setting an electrical signal in a range where the ink can not be discharged, Japanese Laid-Open Patent Application No. 61-189948 has proposed preliminary energizing means for head driving with which a predetermined bias voltage is applied to heat generating elements, Japanese Laid-Open Patent Application No. 62-220345 has proposed a constitution in which heating means for generating the heat energy not forming ink droplets is provided on heat energy generating means for discharging the ink, and Japanese Laid-Open Patent Application No. 63-134249 has proposed a constitution in which second heat energy generating means for controlling the ink temperature is provided in the vicinity of heat energy generating element for discharging the ink.

The relation between the temperature of ink jet head in the form as shown in FIG. 22 and the discharge volume has been investigated.

The ink jet head using the heat energy could detect the temperature in the vicinity of heat generating element by using the variation of resistance value caused by the temperature in a temperature detection layer between the heat generating element 102 and the ink.

Also, the temperature of support plate 106 was detected by a thermistor.

The heat generating element 102 was one in which head generating elements were arranged in about fourteen elements per 1 mm on a Si substrate of about 8 mm×10 mm, and an electrical pulse of about 50 μj for each time was applied.

FIG. 23 is a graph showing the relation between the temperature and the discharge volume when the frequency for giving the electrical pulse and the head temperature are changed.

Note that for the temperature in the vicinity of heat generating element, the temperature immediately before application of each electrical pulse is monitored.

The experimental results as shown in FIG. 23 have revealed that the ink discharge volume can be determined only by the temperature in the vicinity of heat generating element.

Then, the temperature elevation curve was measured in the vicinity of heat generating element immediately after start of repetitive application of electrical pulses with its frequency fixed at about 2 kHz.

FIG. 24 is a graph showing a result of measuring the temperature in the vicinity of heat generating element immediately before application of each electrical pulse.

The graph of FIG. 24 reveals that the temperature in the vicinity of heat generating element has risen by several degrees in about 0.1 seconds after start of driving.

This is attributable to the fact that the substrate 101 and the support plate 106 are bonded by adhesion between different materials of Si and Al in which the thermal resistance therebetween is not negligible as compared with that within the substrate or the support plate, and the heat capacity of the substrate itself is small.

The ink jet head using heat generating elements (electrothermal converters) for discharging the ink (thereafter sometimes referred to as a heat ink jet head) comprises heat generating elements of a hard material with a low thermal expansion coefficient such as Al or $Al_2O_3$, like a semiconductor, selected to form the heat generating element 102 of thin film on the substrate 101.

Also, the support plate 106 uses an inexpensive metal such as Al, because of its excellent processibility for mounting on a recording apparatus main body, and a material with a high thermal conductivity for decreasing the radiation resistance.

Accordingly, as above described, it is necessary to bond an inorganic nonmetal material and a metal, using a thermal conductive adhesive to reduce the thermal resistance with the adhesion, but in the current art, it is difficult to remove the temperature elevation in a short time as previously described. As a result, the discharge volume of ink liquid droplets may be abruptly changed during recording of an image, and cause irregularities on the image.

The examination of conventional technologies from such a point of view has revealed the following technical problems.

To begin with, the ink jet head as disclosed in U.S. Pat. No. 4,719,472 and Japanese Laid-Open Patent Application No. 1-133748 has a temperature sensor attached within a common liquid chamber or reservoir. Thereby, it is possible to detect an abrupt change of substrate temperature and control the temperature of the same substrate, but there is a problem that high speed is required for control, thereby making a control apparatus larger, which will increase the cost of head.

Also, the head as disclosed in Japanese Laid-Open Patent Application No. 63-116857 has temperature detecting means provided in the vicinity of heat generating element within each liquid channel, so that the temperature control can be effectively made with such means. However, in this case, there are some problems that many temperature detecting means are needed, and further, the comparator circuit, operation circuit and control circuit become larger, so that the cost of head is increased.

Also, the head as disclosed in Japanese Laid-Open Patent Application No. 1-184416 has an advantage that the temperature control can be performed relatively precisely, but there is a problem that the constitution of head is complex because a temperature sensor is incorporated on the substrate to make the control to compensate for the temperature distribution using heat generating elements.

Japanese Laid-Open Patent Application No. 61-146550, Japanese Laid-Open Patent Application No. 61-189948, Japanese Laid-Open Patent Application No. 62-220345, Japanese Laid-Open Patent Application No. 63-134249 have proposed auxiliary heat generating means for head, but there is proposed no method for making the head temperature constant or equalizing the distribution of head temperature.

SUMMARY OF THE INVENTION

In view of the foregoing technical problems, the present invention is aimed to provide a driving method for an ink jet head capable of making a high-quality, stable recording, without irregularities on image, by equalizing the temperature distribution while maintaining the temperature of substrate constant, with a simple construction having no provision of temperature detecting means or complex control means within a substrate.

Another object of the present invention is to provide a driving method for an ink jet head comprising one or more discharge ports for discharging the ink, a substrate incorporating one or more heat generating elements for generating the heat energy, each of which is provided correspondent to each discharge port, and a support plate or casing on which said substrate is mounted, the driving method being capable of making the high-quality, stable recording without irregularities on image by equalizing the temperature distribution while maintaining the substrate temperature constant, with a simple construction having no provision of temperature detecting means or complex control means within the substrate, wherein the method is constituted such that when an image is recorded with the ink jet head in which the heat energy for discharging the ink in accordance with an image signal is generated in the heat generating elements, and the thermal resistance value passing through the support plate or casing is lower than that not passing through the support plate or casing among the thermal resistance between the substrate and the external, $(E_{max}-E)/(V_{max}-V)$ is controlled to be always substantially constant whenever $E \neq E_{max}$, providing that the thermal energy generated in the substrate is $E_{max}$ when the ink jet head discharges the ink with a maximum volume of $V_{max}$, the ink discharge volume in accordance with the image signal is V, and the heat energy generated in the substrate at this time is E.

With the driving method for ink jet head of the present invention, it is possible to maintain the temperature on the substrate, particularly in the vicinity of heat generating element, and equalize the temperature distribution in a direction of array of heat generating elements on the substrate, in such a manner as to generate, in addition to the heat energy in accordance with an image signal by means of heat generating elements on the substrate, the heat energy on the substrate regardless of image signal or in accordance with the inverse of image signal.

DETAILED DESCRIPTION OF THE PREFERRED EMBODIMENTS

Example 1

Figure 1A:
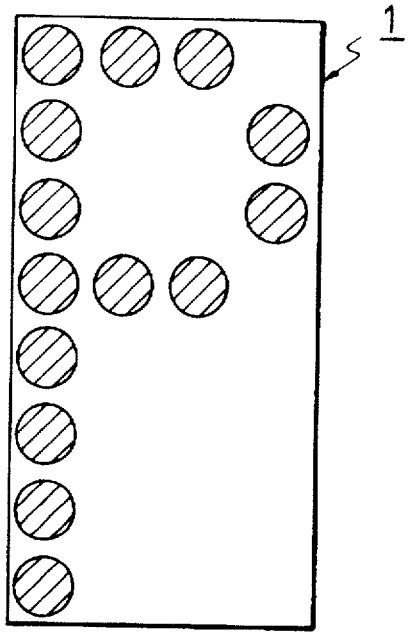
FIGS. 1A to 1C are typical views illustrating a character pattern and head driving pulses in a first example for the driving method for ink jet head according to the present invention.
Figure 1C:
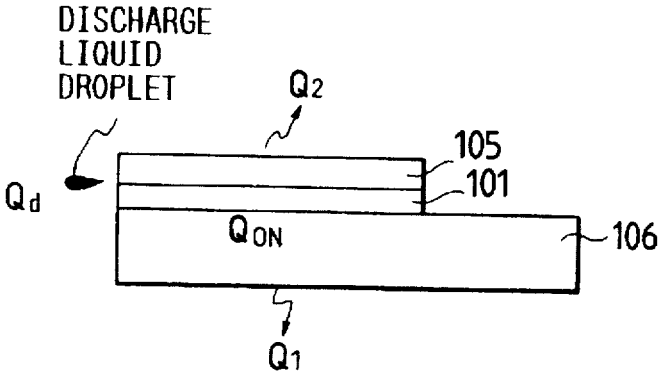
Figure 1B:
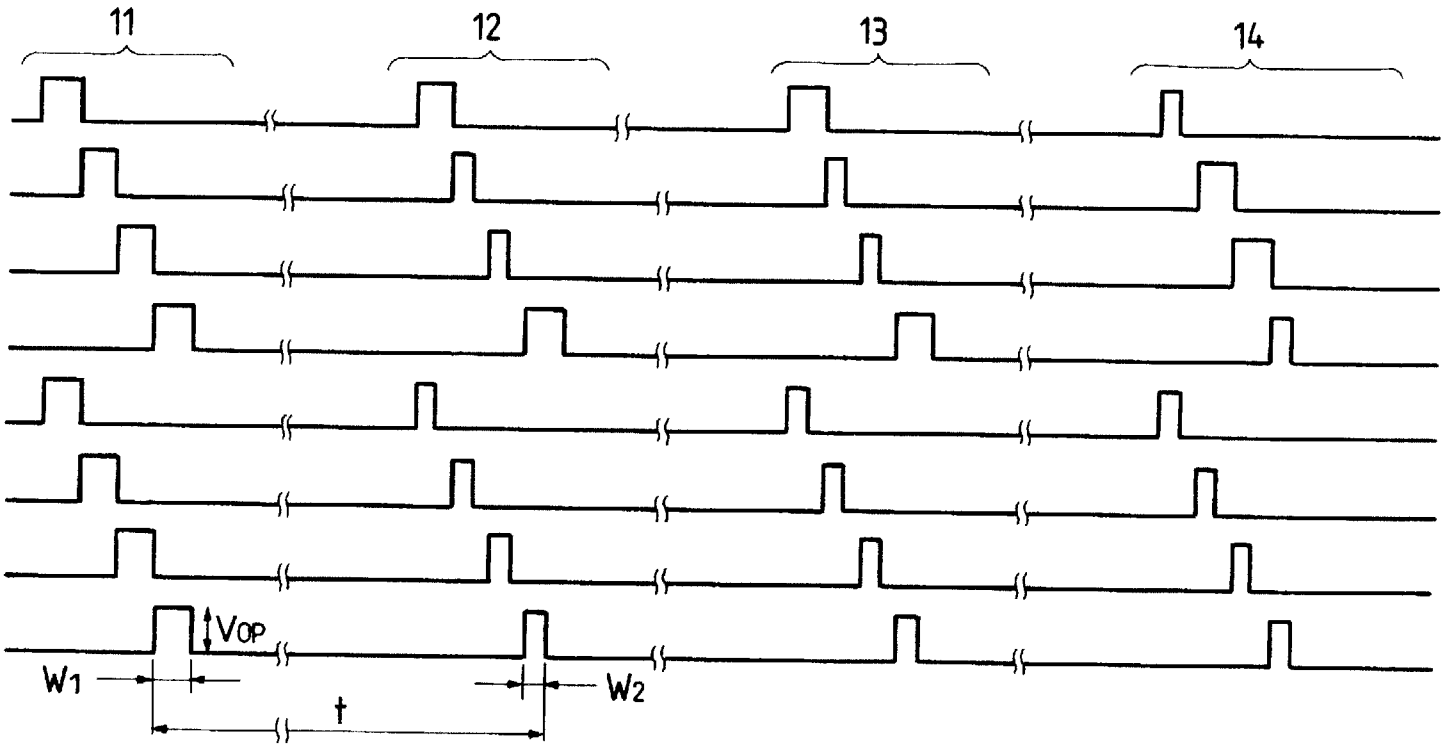
Figure 2A:
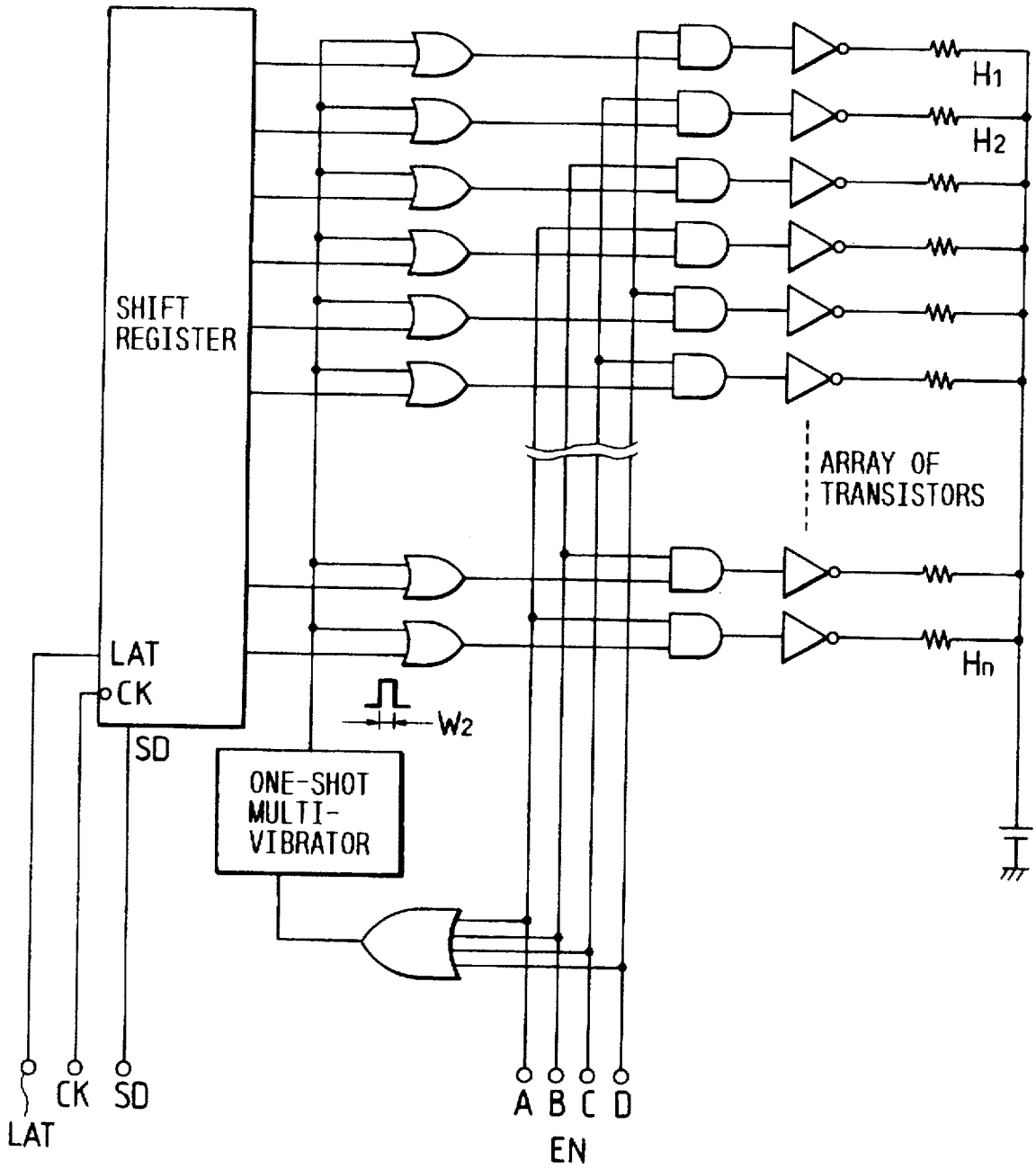
FIG. 2A is a circuit diagram exemplifying a driving circuit used in the first example.
Figure 2B:
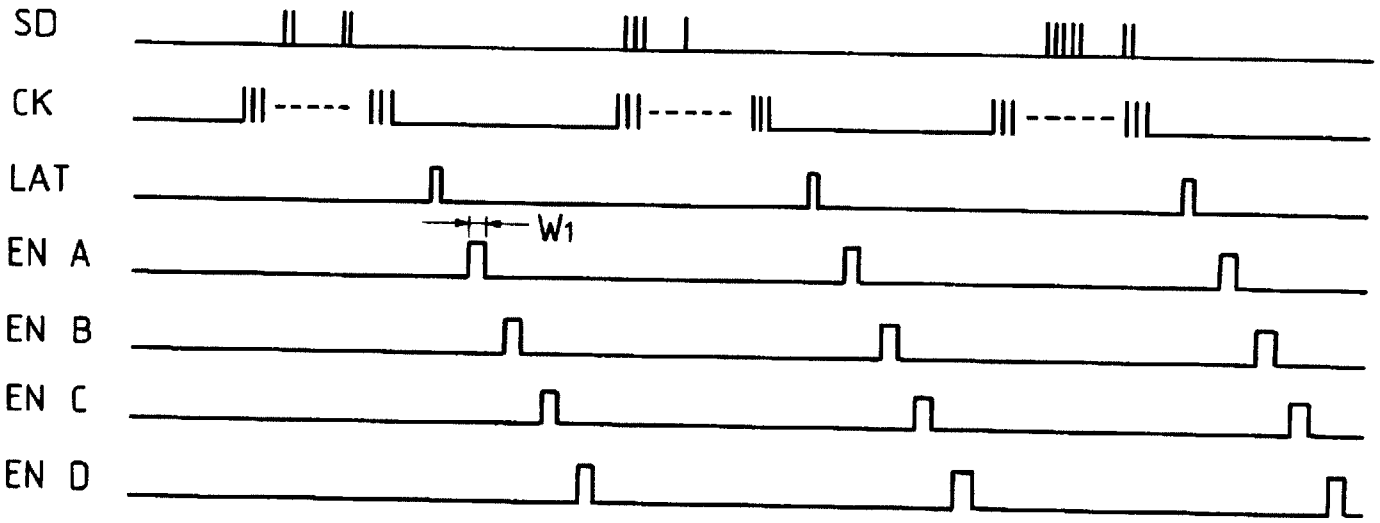
FIG. 2B is a timing chart exemplifying actuating signals for the circuit of FIG. 2A.

FIGS. 1A, 1B and 1C are views illustrating the driving pattern for heat generating element in the first example of the driving method for ink jet head according to the present invention. FIG. 2A is a driving circuit diagram used in the first example as shown in FIG. 1, and FIG. 2B is a timing chart for driving the circuit of FIG. 2A.

In FIG. 1A, 1 shows an example of a character pattern, and in the same pattern, dots in each column are discharged at the same time.

Numeral 11 is an electrical pulse wave shape to be given to each heat generating element in recording the first column of pattern. Similarly, 12, 13 and 14 are electrical pulse wave shapes to each heat generating element in recording the second, third and fourth columns of pattern, respectively.

The time interval $\tau$ between electrical pulses is constant.

Each electrical pulse has a pulse width of $w_1$ when image signal is ON, and a pulse width of $w_2$ when image signal is OFF, in which the difference between the quantity of heat $Q_{ON}$ generated at ON and that $Q_{OFF}$ generated at OFF is set to be energy $Q_d$ taken away by ink droplets. That is, $Q_{OFF}=Q_{ON}-Q_d$. Accordingly, the energy residual on a substrate is made constant.

Referring to a driving circuit of FIG. 2A and a timing chart of FIG. 2B, a latch is contained in a shift register to transmit image data to be recorded, in synchronism with the clock, followed by a latch pulse.

As heat generating elements $H_1$ to $H_n$ corresponding to a plurality of discharge ports are undesirable to drive concurrently because of a well known reason, they are driven in four divided blocks.

To this end, four enable pulses of ENA, ENB, ENC and END (each having a pulse width of $w_1$) are transmitted.

In synchronism with the rising of each enable pulse ENA, ENB, ENC and END, an one-shot multivibrator is set at high level for a period of $w_2$. Thus, heat generating elements are driven for the period of $w_2$, regardless of image data.

Figure 22:
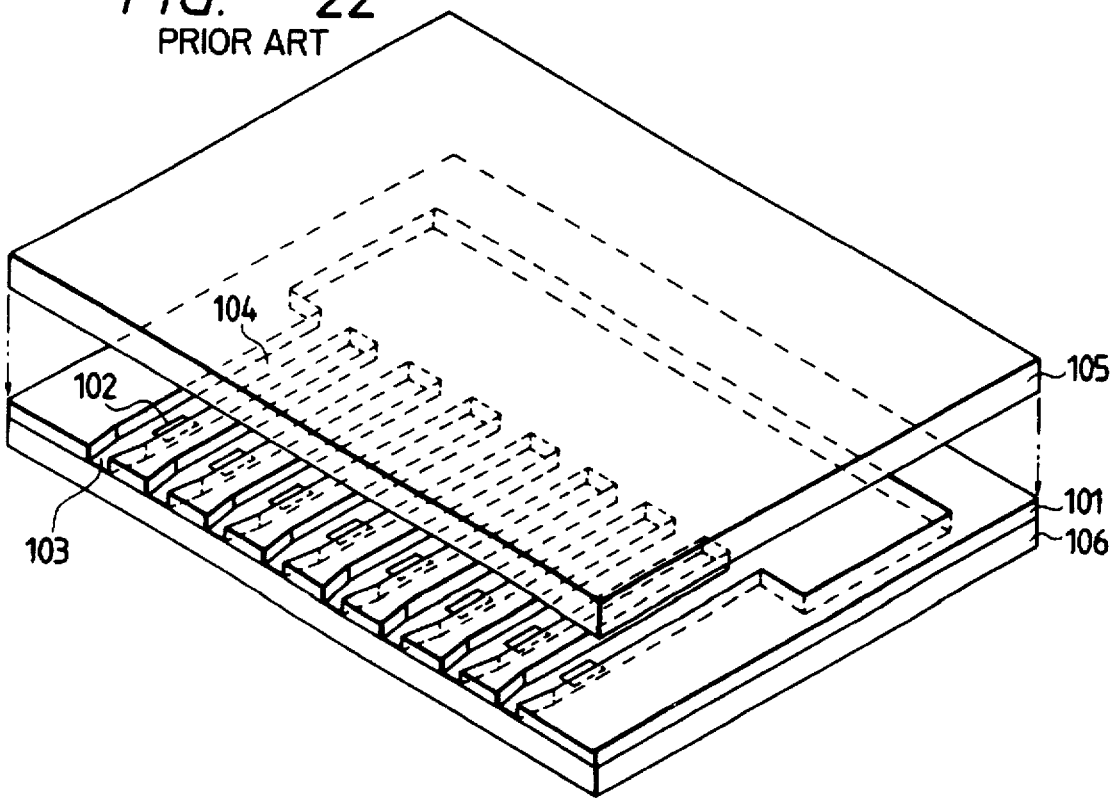
FIG. 22 PRIOR ART
FIG. 22 is a typical exploded perspective view illustrating a constitution of an ink jet head appropriate for use when the present invention is carried out.
Figure 23:
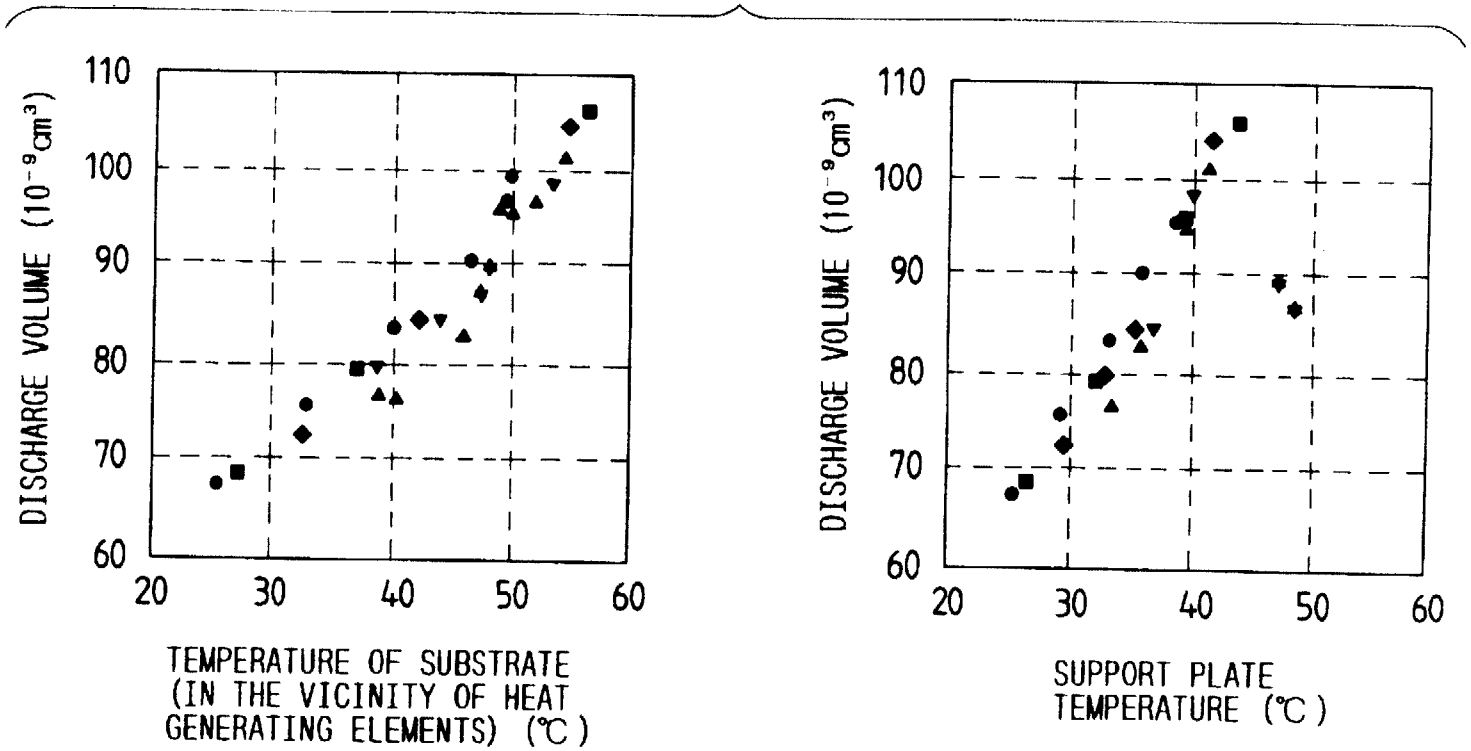
FIG. 23 is a graph illustrating the relation between the temperatures of substrate and support plate for head and the ink discharge volume.
Figure 24:
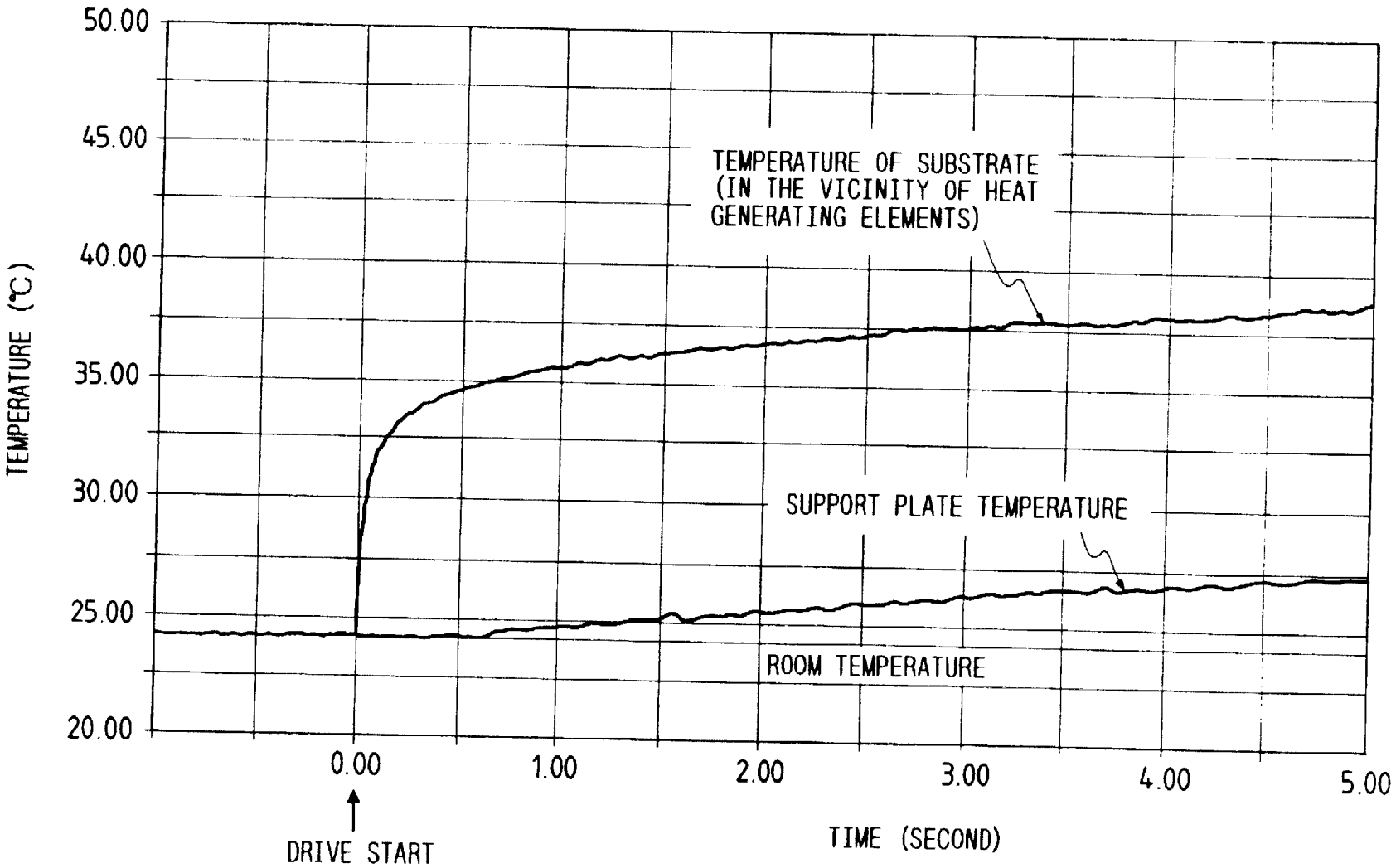
FIG. 24 is a timing chart illustrating the temperature variations of substrate and support plate after the driving of head has been started.

In this example, an ink jet head in the form as shown in FIG. 22 is used.

This ink jet head is one in which image is recorded by discharging the ink through discharge ports by growth of bubbles owing to film boiling caused with the heat energy applied by the electro-thermal converters.

The ink jet head has eight discharge ports 103 to each of which is connected one liquid channel 104 in which one heat generating element 102 for discharge is provided.

The same head can record onto a recording medium while moving in a direction perpendicular to the substrate 101. In the same head, a support plate 106 is made of Al, its dimension being such that $S_1$=20 mm×50 mm, $t_1$=3 mm thick, a thermal conductivity $\lambda_1$=230 w/m°C., and a volume specific heat $\rho_1 c_1=2.4\times10^6$ J/m$^3$·°C.

A ceiling plate 105 is made of glass, its dimension being such that $S_2$=10 mm×15 mm, $t_2$=1 mm thick, a thermal conductivity $\lambda_1$=1.5 w/m·°C., and a volume specific heat $\rho_2 c_2=1.6\times10^6$ J/m$^3$·°C.

The area in contact with the external is $S_1'$=1500 mm for the support plate, and $S_1'$=150 mm$^2$ for the ceiling plate 105.

The substrate 101 of the same head is not in contact with other than the ceiling plate or support plate, having a thermal conductivity of $\alpha$=30 w/m·°C. to the external, and a thermal resistance between substrate 101 and support plate of $R_g$=0.9 °C./w.

At this time, among the thermal resistance between the substrate 101 and the external, the thermal resistance through the support plate 106 is $$R_1=t_1/(S_1\lambda_1)+R_g+1/(S_1'\alpha)=23.1°\ \text{C./w}$$

and the thermal resistance through other portion, i.e., the ceiling plate 105, is $$R_2=t_2/(S_2\lambda_2)+R_g+1/(S_2'\alpha)=227°\ \text{C./w}$$

in which $R_1 \ll R_2$.

The heat capacities $C_1$, $C_2$ for the support plate 106 and the ceiling plate 105 are $$C_1=\rho_1 c_1 \rho_1 t=7.2\ \text{J/°C.}$$

and $$C_2=\rho_2 c_2 \rho_2 t=0.24\ \text{J/°C.}$$

respectively, in which $C_1 \ll C_2$.

The heat energy residual on the substrate 101 mainly propagates to the support plate, where it is accumulated and radiated to the outside.

A method for determining widths $w_1$, $w_2$ of electrical pulse will be now described, in which $w_1$ is a pulse width for stable discharge of ink at the voltage $V_{op}$ suitable for a driving circuit.

The ink is discharged by driving all heat generating elements 102 for discharge at each fixed interval $\tau$, with the pulse width $w_1$. During this time, the temperature may gradually rise.

The temperature of support plate 106 for the same head is detected using a thermistor, for example. If the temperature reaches a constant value, that temperature is set as T∞.

Then, the temperature is also measured by applying electrical pulses having an appropriate pulse width w' shorter than $w_1$ and not large enough to discharge the ink to the heat generating elements at the same voltage as before, and if reaching a constant value, that temperature is set as T'∞.

The same measurement is performed by changing $w_1$ until T'∞ becomes substantially equal to T∞. If T'∞ becomes substantially equal to T∞, then w is set as $w_2$. The permissible error between T'∞ and T∞ is 1 to 2° C., depending on the thermal resistance between the substrate 101 and the support plate 106, and the radiation resistance of the support plate 106.

The method for determining $w_2$ can be more simply achieved by $w_2=(T\infty-T_{env})w'/(T'\infty-T_{env})$, where $T_{env}$ is the environmental temperature.

Note that it is also possible to first determine $w_1$ to obtain the voltage $V_{op}$ at which the ink is stably discharged, and then transfer to a procedure for determining $w_2$ as above described.

In this way, by determining the pulse widths $w_1$, $w_2$, $(E_{max}-E)/(V_{max}-V)$ can be maintained substantially constant without the needs of special temperature control.

The reason for that is as follows.

In the above procedure for determining $w_1$, $w_2$, the fact that the temperature on the substrate when electrical pulses are supplied to the heat generating elements at the pulse width $w_1$ is equal to the temperature when electrical pulses are supplied to the same heat generating elements at the pulse width $w_2$ means that both heat fluxes passing through the support plate are equal.

In the ink jet head used in this example, most of heat flowing from the substrate 101 to the external may pass through the support plate 106 as above described, and $Q_1 \gg Q_2$ in FIG. 1C, so that the heat energy generated in the substrate minus the heat flux transferring to the support plate is the amount of energy taken out to the external by the ink in discharging.

The value of energy taken out is $V_{op}^2/R_n(w_1-w_2)$ per discharge, where $R_n$ is the electrical resistance value of heat generating resistor.

As the kinetic energy of liquid droplets is generally negligible as compared with the heat energy which the liquid droplets contain, the energy $\rho$ taken out to the external by the liquid droplets (ink) is $CV_d(T_h-T_{env})$.

Here, $\rho$, C are the density and specific heat of ink, respectively, and $T_h$ is the temperature in the vicinity of heat generating element when driven at the pulse width $w_1$, which is approximately equal to the temperature of ink droplets for discharge.

Accordingly, the expression $$(V_{op}^2/R_h)(w_1-w_2)=\rho C V_d(T_h-T_{env}) \quad (1)$$

will stand.

When ink droplets having the volume $V_n$ and the temperature $T_x$ are discharged through n discharge ports among N discharge ports, respectively, the heat energy generated by the heat generating elements is $$E=(V_{op}^2/R_h)\{nw_1+(N-n)w_2\} \quad (2)$$

and the energy taken out by the ink in discharging is $$E_{ejc}=n\,\rho CV_x(T_x-T_{env}) \quad (3)$$

Accordingly, the energy residual on the substrate 101 to pass through the support plate 106 afterwards is $$E_{res}=E-E_{ejc}=(V_{op}^2/R_h)\{nw_1+(N-n)w_2\}-n\rho CV_x(T_x-T_{env})=(V_{op}^2/R_n)\{nw_1+(N-n)w_2\}-n\rho CV_d(T_h-T_{env})+n\rho C\{V_d(T_h-T_{env})-V_x(T_x-T_{env})\} \quad (4)$$

Here, using the above expression (1), the expression $$E_{res}=N(V_{op}^2/R_h)w_2+n\,\rho C\,\{V_d(T_h-T_{env})-V_x(T_x-T_{env})\} \quad (5)$$

is obtained.

Note that the relation between $V_x$ and $T_x$ is an increasing function of $V_x$ and $T_x$, and so $E_{rcs}$ is regarded as the function of $T_x$.

On the other hand, as $T_x-T_{env}$ is proportional to $E_{rcs}$ in the steady state, the expression $$T_x=(T_h-T_{env})E_{res}/(Nw_2V_{op}^2/R_h)+T_{env} \quad (6)$$

is obtained.

However, in practice, as there are heat capacities in the substrate 101 and the support plate 106, the temperature $T_x$ as indicated in the above expression is not necessarily reached, but is a converged value of temperature.

Figure 3:
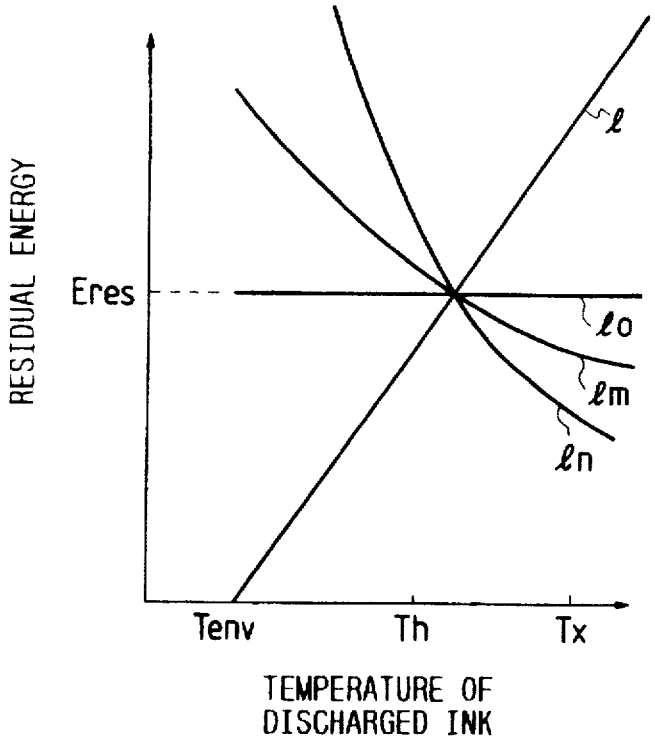
FIG. 3 is a graph illustrating the relation between the temperature of discharged ink and the residual energy of substrate.

FIG. 3 is a graph showing the relation between $E_{rcs}$ in the expression (5) and $T_x$ in the expression (6).

In the same figure, 1 shows the line as indicated by the expression (6), and $I_o$, $I_m$, and $I_n$ show the relation of the expression (5) for n=0, n=m, and n=N.

In the same figure, since all curves intersect at one point, it will be understood that the temperature in the vicinity of heat generating element 102 is fed back in a direction of being the constant value $T_h$, irrespective of the value of n.

If the ink discharge volume for each time at the temperature $T_h$ is $V_d$, then the discharge volume of head is $V=nV_d$, with the maximum discharge volume of head being $V_{max}=NV_d$, and the energy generated in the substrate 101 at this time is $E_{max}=N(V_{op}^2/R_h)w_1$, and consequently, $$(E_{max}-E)/(V_{max}-V)=\frac{N(V_{op}^2/R_h)w_1-(V_{op}^2/R_h)\{Nw_1+(N-n)w_2\}}{NV_d-nV_d}=\frac{(V_{op}^2/R_h)(w_1-w_2)}{V_d} \quad (7)$$

which is fixed for n.

In this example, as above described, if there is little variation of environmental temperature, the constant volume of ink droplets can be always discharged regardless of image signal.

Figure 4:
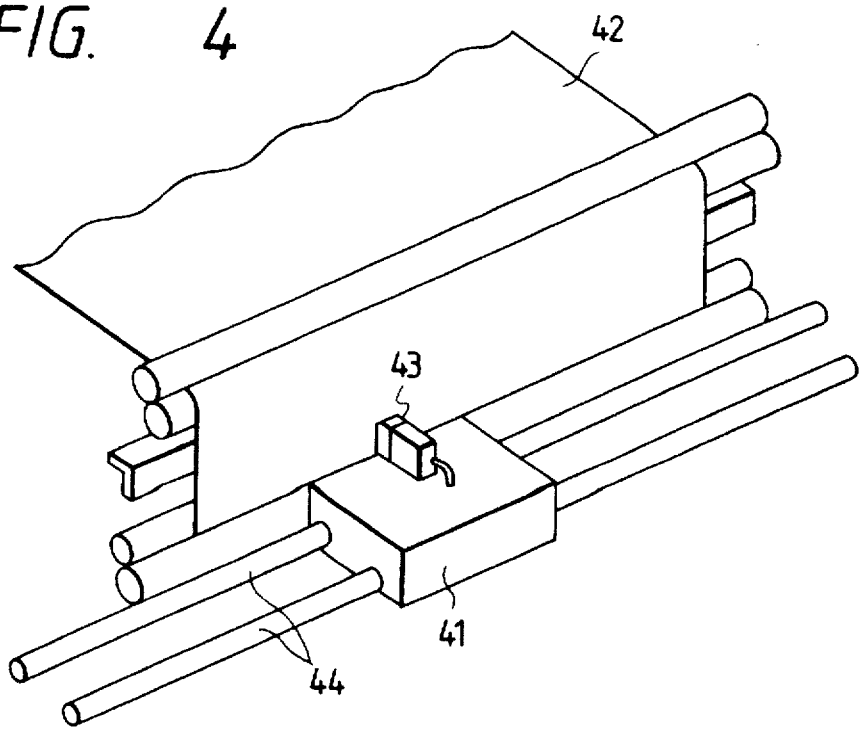
FIG. 4 is a typical perspective view illustrating an ink jet recording apparatus to which a head driving method according to the present invention is appropriately applied.

FIG. 4 is a typical perspective view illustrating an ink jet recording apparatus appropriate for carrying out the driving method for ink jet head according to the present invention.

The ink jet head 1 used in this example was mounted on a carriage 41 of the ink jet recording apparatus as shown in FIG. 4, and the discharge of black ink through each discharge port at intervals of 1 mm seconds, was repeated at a rate of 500 discharges per minute and 500 pauses, while the carriage was being moved at 0.16 m/s. Note that the carriage 41 on which the ink jet head 43 was mounted could reciprocate along guide rails 44.

Accordingly, on recording medium 42, solid recording and blank were repeated at intervals of 80 mms. Note that in recording, no pause signal was issued for a first period of 80 mm.

At the pause of recording, using any of the following pulse widths to be given to each heat generating element, (A) $w_2$ (this example)

(B) No electrical pulses are issued at the pause.

(C) 80% pulse width of $w_2$ (D) 120% pulse width of $w_2$ four recordings were performed.

Figure 5:
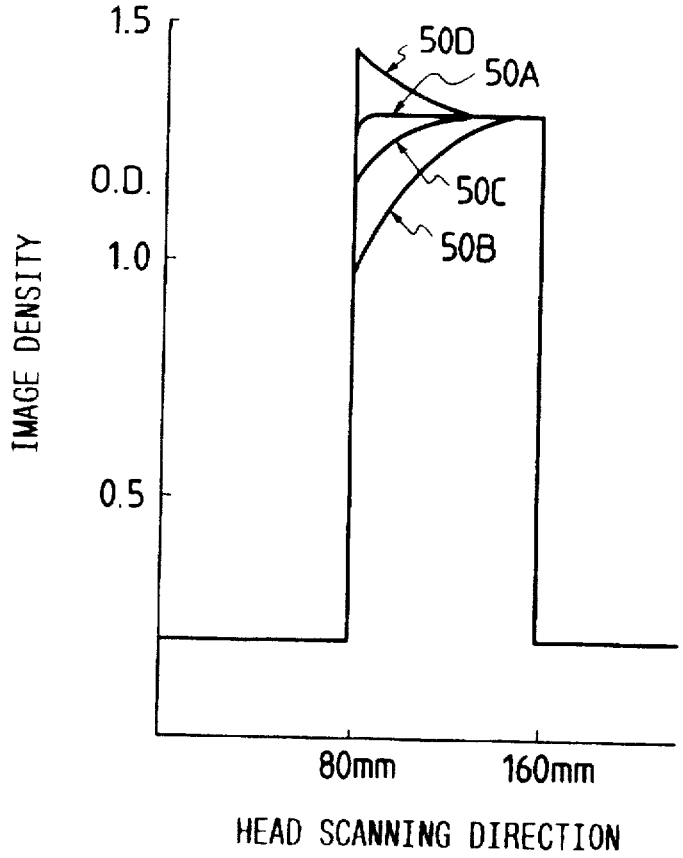
FIG. 5 is a graph showing measurement results of the distribution of image OD value when the first example is applied.

After termination of recording, the distribution of OD value was measured with a microdensitometer. FIG. 5 is a graph showing the results.

In FIG. 5, 50A, 50B, 50C and 50D are results from the above cases (A), (B), (C) and (D), respectively.

First, in the case (A) of this example, the value of OD is constant from the beginning of recording, while in the case of (B), the value of OD is low at the beginning of recording.

In the case of (C), the value of OD at the beginning of recording is higher than that in the case of (C), but still insufficient. Also, in the case of (D), as the too large amount of heat is generated at the pause of signal, the value of OD at the beginning of recording is too high, then returning to a normal value afterwards.

The driving method for ink jet head in this example (example 1) is in principle effective to keep the image density constant if the variation of the room temperature is small within a recording time.

However, when in a recording of long duration, the room temperature is largely changed within such time, or the reproducibility of image density is required within a period during which the room temperature is largely changed, it is preferable to make the following control.

That is, for example, with a temperature sensor and heating and/or cooling means attached to the support plate 106, control means is provided to reduce the variation of temperature on the support plate, and to cause a control circuit to control so that the temperature of the support plate may be kept at the same temperature as that when $w_1$, $w_2$ are determined as previously described.

In this case, as the control is made corresponding to the variation of the room temperature, it is sufficient that the speed of feedback is in a unit of second.

To carry out the driving method in this example effectively, more than half the heat residual on the substrate 101 must pass into the support plate 106, and preferably, almost all the heat residual on the substrate may pass into the substrate.

For this purpose, it is effective that the ceiling plate 1-5 is made of glass which has a low thermal conductivity, and covered with a resin, and further, in the vicinity of discharge ports 3, the substrate 101 may be covered with a casing having good thermal conductivity to which the temperature sensor and auxiliary heating means are attached.

Note that in the above control for the variation of the room temperature, auxiliary heating means must not be directly provided on the substrate. The reason is that error may occur by the amount of thermal resistance between the substrate and the support plate, and is not negligible.

As above described, when with the temperature sensor and auxiliary heating means attached to the support plate, means is provided to control the temperature of the substrate so that it may be kept constant with the control circuit, $w_2$ as previously described can be determined with the following method.

That is, $w_2$ can be determined in such a method that in the state where temperature control means is operated under a constant environmental temperature in an environmental test room, the powers for making above control are made substantially equal, when the heat energy in accordance with image signal ON is continuously supplied to all the heat generating elements 102 on the substrate 101 and when the heat energy in accordance with image signal OFF is continuously supplied to all the heat generating elements 102.

More specifically, $w_2$ can be determined so that the difference between both powers lies within 5%. By using such $w_2$, the heat flux passing from the substrate 101 to the support plate 106 can be maintained constant, so that the substrate temperature can be kept constant.

The driving method for ink jet head according to the present invention is also effective when the wiring resistance on the substrate for supplying the power to the heat generating elements is not negligible as compared with the electrical resistance of heat generating elements. Moreover, when a heat generative device such as a driver IC is mounted on the substrate, it is also applicable if the amount of heat generated by the device is substantially proportional to the length of enable signal.

Also, when the instantaneous temperature elevation caused when driven at the pulse width $w_2$ causes the ink to be discharged or has a bad influence on the heat generating elements or the ink, the objects of the present invention can be accomplished by temporarily dispersing the heat energy when image signal is OFF, as will be described later.

Example 2

Figure 6:
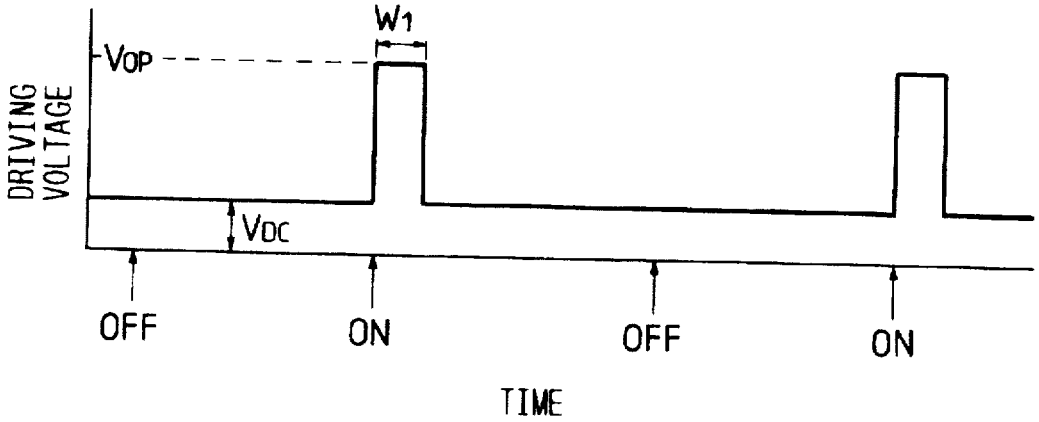
FIG. 6 is a timing chart exemplifying head driving pulses in a second example for the driving method of ink jet head according to the present invention.

FIG. 6 is a graph illustrating head driving pulses in the second example of the present invention.

An ink jet head used in this example is the same as that in the first example.

In this example, the heat energy generated without respect to image signal is given by a minute steady voltage $V_{DC}$ in FIG. 6.

In a case where with the driving method of the first example, the ink is discharged through some of discharge ports when recording signal is OFF, the use of the driving method in this example is effective.

Figure 7:
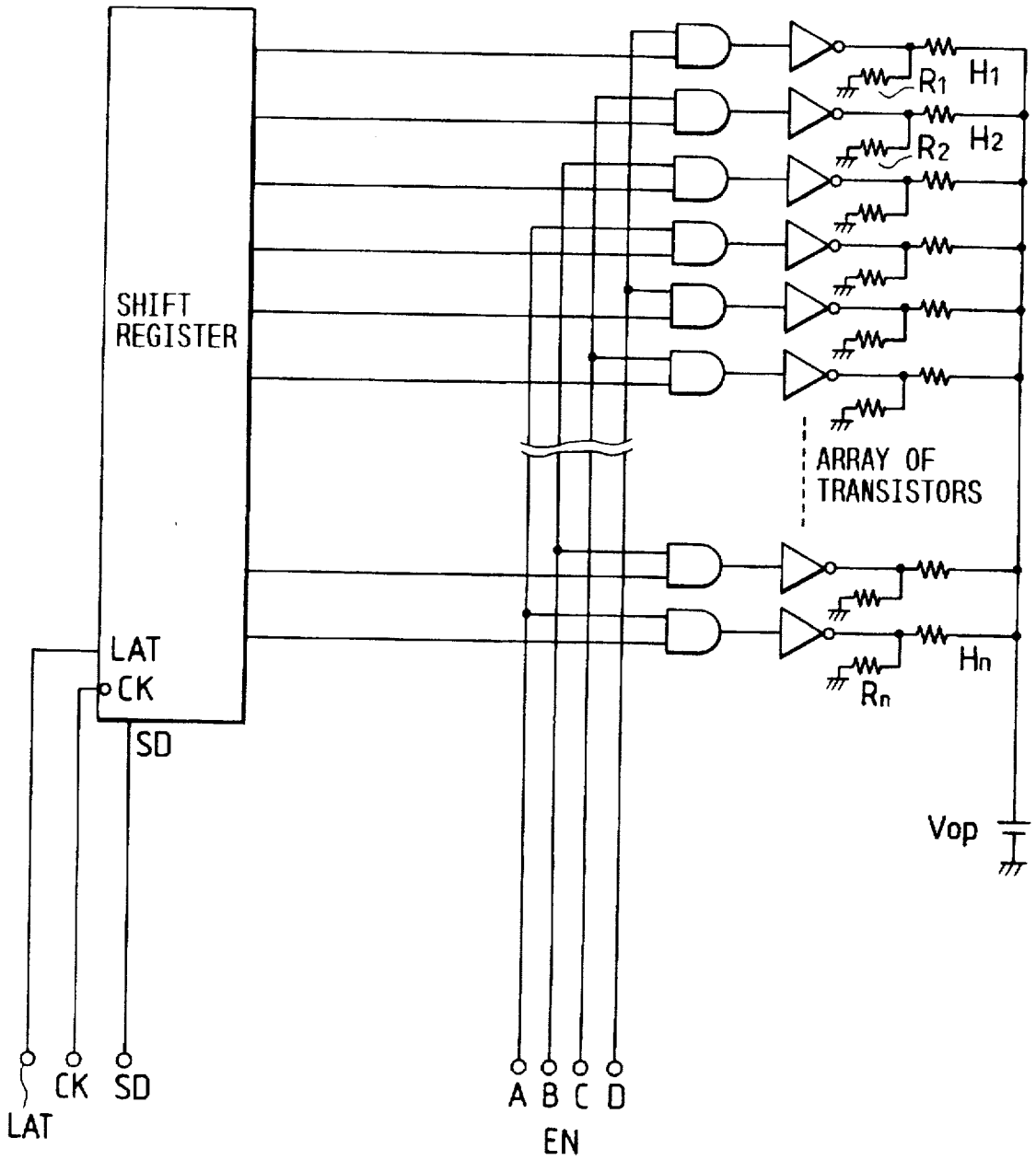
FIG. 7 is a circuit diagram exemplifying a driving circuit used in the second example.

FIG. 7 shows an example of a circuit for carrying out the driving method of this example (example 2).

Note that the driving timing for this circuit is the same as that of example 1 shown in FIG. 2.

In the circuit of FIG. 7, resistors $R_1$ to $R_n$ are provided in parallel to the array of transistors at the output stage.

Accordingly, the current will flow through the heat generating elements $H_1$ to $H_n$, even when transistors in the transistor array are OFF.

It is assumed that the resistance value for each of $R_1$ to $R_n$ is $R_R$ and the resistance value for each of $H_1$ to $H_n$ is $R_H$. $V_{DC}$ which is applied to the heat generating elements $H_1$ to $H_n$ is $$V_{DC} = \frac{R_H}{R_R + R_H} V_{op}$$

$R_1$ to $R_n$ are normally provided within the driving circuit of head, but can be provided within the head, particularly in the vicinities of heat generating elements $H_1$ to $H_n$. In that case, the heat generated by the driving circuit can be made less than when provided within the driving circuit, so that the total consumption power can be reduced.

Figure 8:
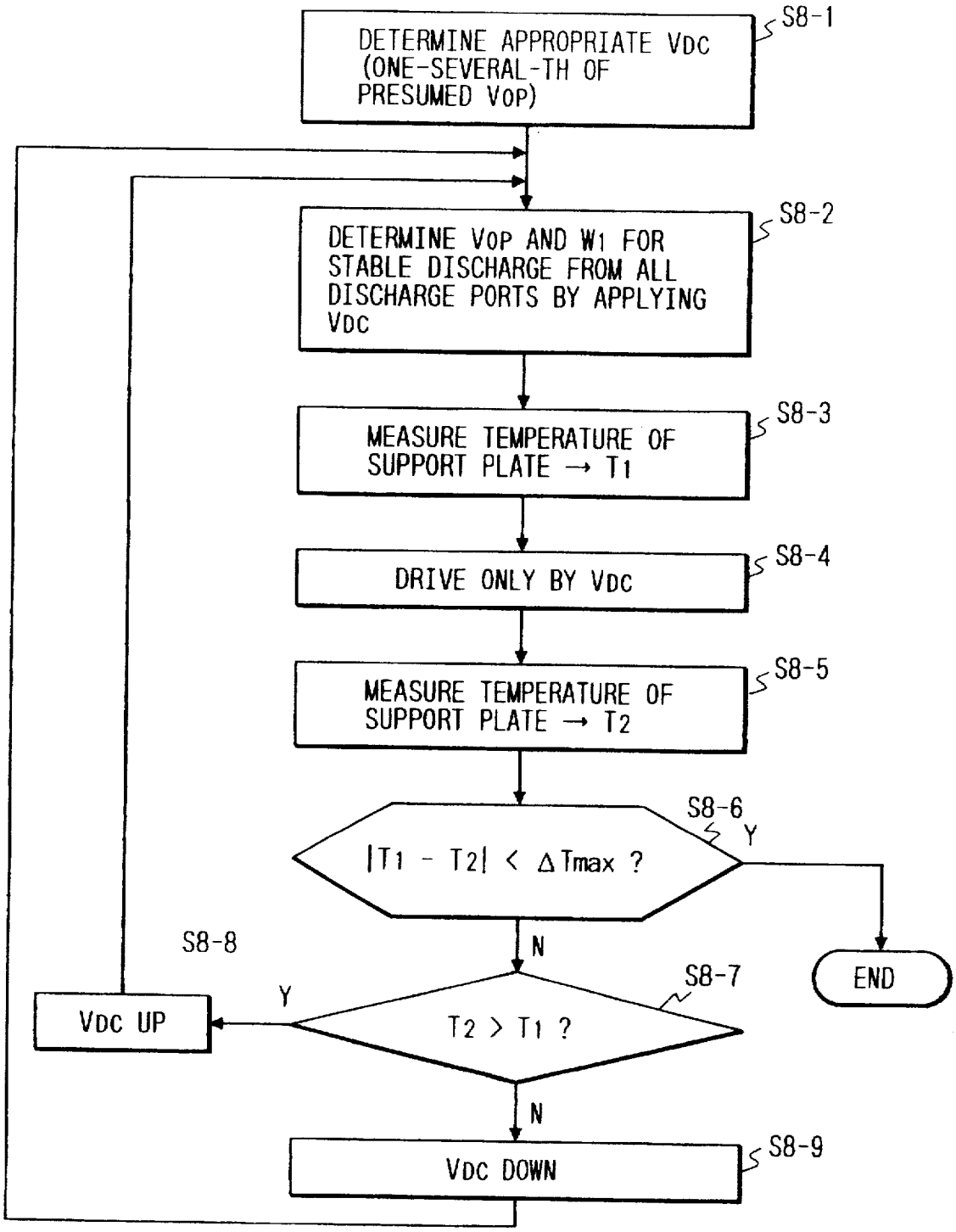
FIG. 8 is a flowchart illustrating an operation procedure in the second example.

FIG. 8 is a flowchart showing an example of a procedure for determining the driving voltage $V_{op}$ and the pulse width $w_1$ when image signal is ON, and the previously-mentioned steady minute voltage is $V_{DC}$.

Figure 21:
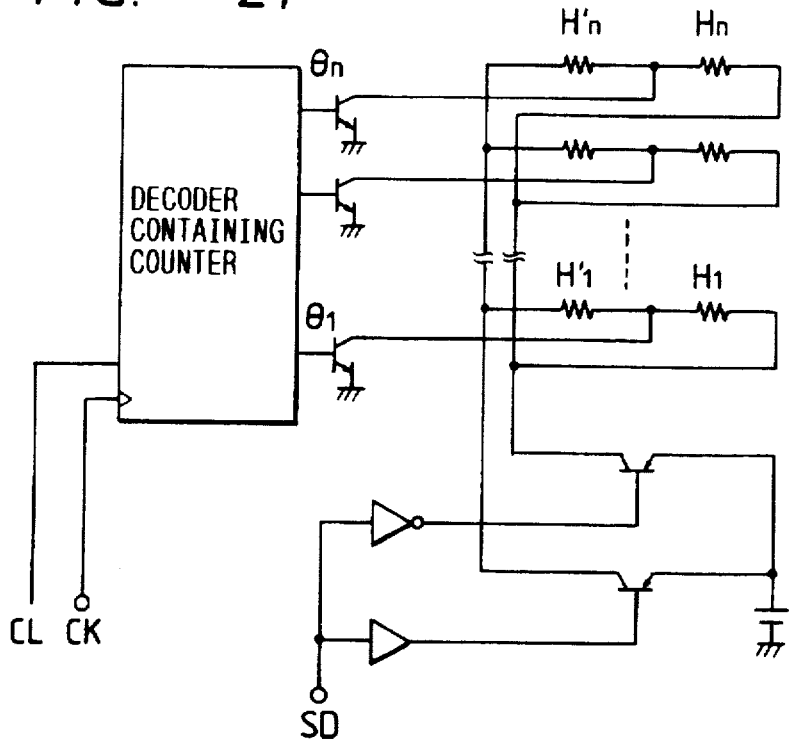
FIG. 21 is a circuit diagram exemplifying a driving circuit used in the sixth example.

In FIG. 8, the first step S8-1 is a step of determining appropriately the steady minute voltage $V_{DC}$ in FIG. 21. This value is set to be a fraction of presumed $V_{op}$.

The next step S8-2 is a step of determining experimentally $V_{op}$ and $w_1$ for stable discharge from all discharge ports by applying $V_{DC}$. $V_{op}$ and $w_1$ are preferably set at their lower limits in a range of stable discharge.

Which of $V_{op}$ and $w_1$ is to be determined preferentially depends on the conditions of the circuit such as the type of driving transistor.

Next, this stable discharge is continued for a while, and if the temperature on the substrate 106 in the ink jet head reaches a constant value, that constant temperature is set as $T_1$ at step S8-3.

The step S8-4 is a step where the $V_{DC}$ is only applied to the head, and the next step S8-5 is a step where if the temperature of support plate reaches a constant value, that constant temperature is set as $T_2$.

The step S8-6 is a step where $T_1$ and $T_2$ are compared. If both temperatures are substantially equal, $V_{DC}$, $V_{op}$ and $w_1$ until this time are determined, and the procedure of this example is terminated.

If $T_2>T_1$ (step S8-7), the $V_{DC}$ is down (step S8-8), and the procedure returns to the step S8-2.

If $T_1>T_2$, the $V_{DC}$ is up (step S8-9), and the procedure returns to the step S8-2.

Here, $\Delta T_{max}$ is a tolerance for the difference between $T_1$ and $T_2$, which is 1° to 2° C., like in the example 1.

If $T_1$ is quite different from $T_2$, the quantitative criterion for changing $V_{DC}$ in steps S8-8 and S8-9 is preferably given by $$V_{DC}(NEW)=V_{DC}(OLD)(T_1-T_{env})/(T_2-T_{env})$$

Where $T_{env}$ is the environmental temperature, and $V_{DC}$ (OLD) and $V_{DC}$(NEW) are $V_{DC}$ before and after change in the steps S8-8 or S8-9, respectively.

The procedure as shown in FIG. 8 can be performed manually like in the example 1, or automatically under the control of CPU.

When the recordings of solid image and blank were repeated at intervals of 80 mms, in the same way as the previous example, using the ink jet head in this example, almost the same results as the previous example could be obtained.

Also, in this example, control means is provided to reduce the temperature variation of the support plate 105, like in the previous example, and by controlling the temperature of the support plate to be kept at the temperature when w, $V_{op}$ and $V_{DC}$ are determined, the invariability of image density can be maintained at different room temperatures.

In this example, in connection with the ink jet head as above constituted, to provide means for determining the driving voltage $V_{DC}$ not dependent upon image signal, the following method can be adopted like in the previous example 1.

That is, in the state where the above control circuit is operated under the condition of maintaining the room temperature constant, the $V_{DC}$ can be selected so that the temporal average value of power for making the control as above described when image signal ON is continuously applied to all the heat generating elements is substantially equal to the temporal average value of power when image signal OFF is continuously applied to all the heat generating elements, or more specifically the difference is within 5%.

The driving method for the ink jet head in this example (example 2) is also effective when the wiring resistance on the substrate for supplying the power to the heat generating elements is not negligible as compared with the electrical resistance of heat generating elements.

Also, the driving method in this example is superior to the example 1 in that there is no discharge of ink when image signal is OFF, but has a larger power applied to the ink jet head than in the example 1.

Example 3

Figure 9:
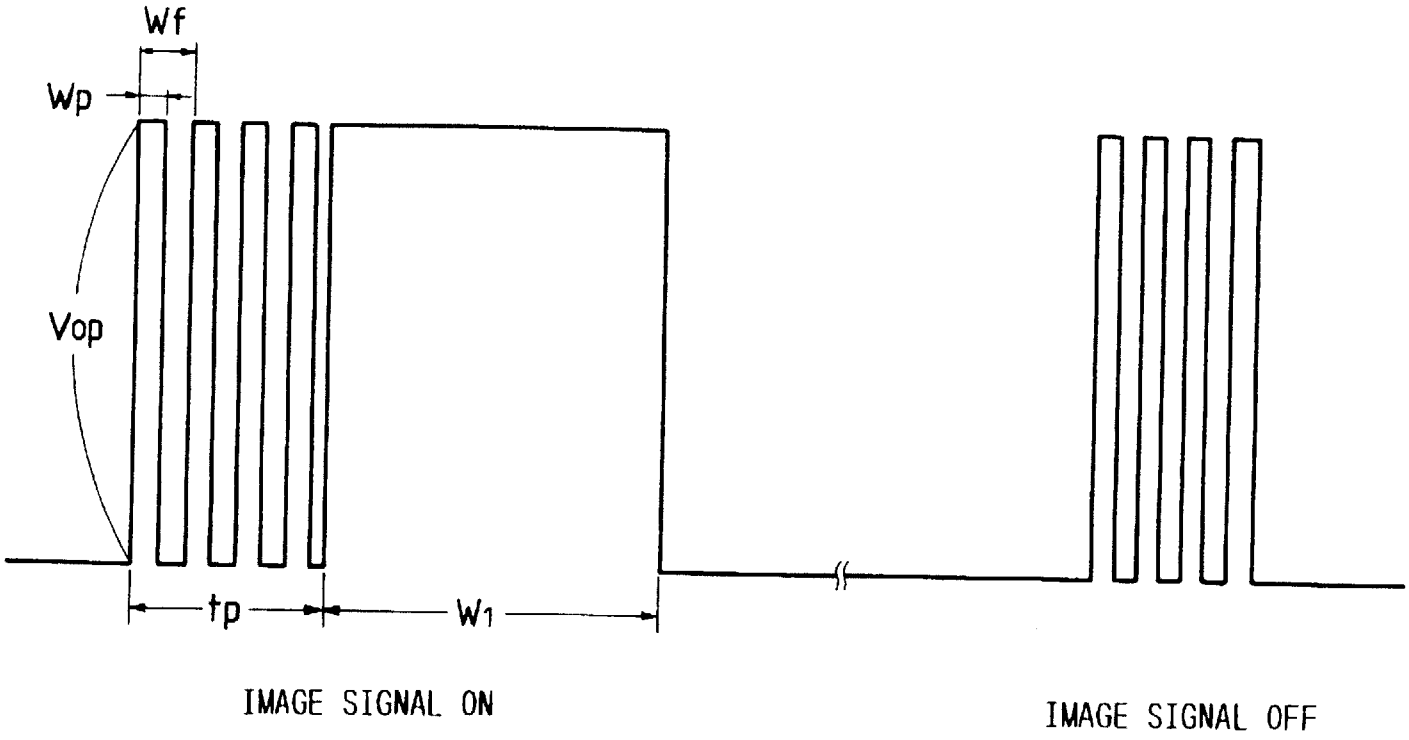
FIG. 9 is a timing chart exemplifying head driving pulses in a third example for the driving method of ink jet head according to the present invention.

FIG. 9 is a graph illustrating head driving pulses in the third example of the driving method for ink jet head according to the present invention.

The ink jet head used in this example is also the same as that in the examples 1 and 2.

The feature of this example is that the heat energy generated regardless of image signal is caused by plural electrical pulses having minute widths.

In FIG. 9, $V_{op}$ and $w_1$ are the voltage and the pulse width of electrical pulse (discharge pulse) issued to the heat generating elements when image signal is ON. $t_p$ is a time during which a plurality of minute pulses are applied, i.e., the time from the start of applying minute pulses to the start of applying the pulse having the width $w_1$ as above indicated.

$w_p$ and $w_f$ are the width of minute pulse and the cycle period. Accordingly, the number of minute pulses is about $t_p/w_f$.

Figure 10:
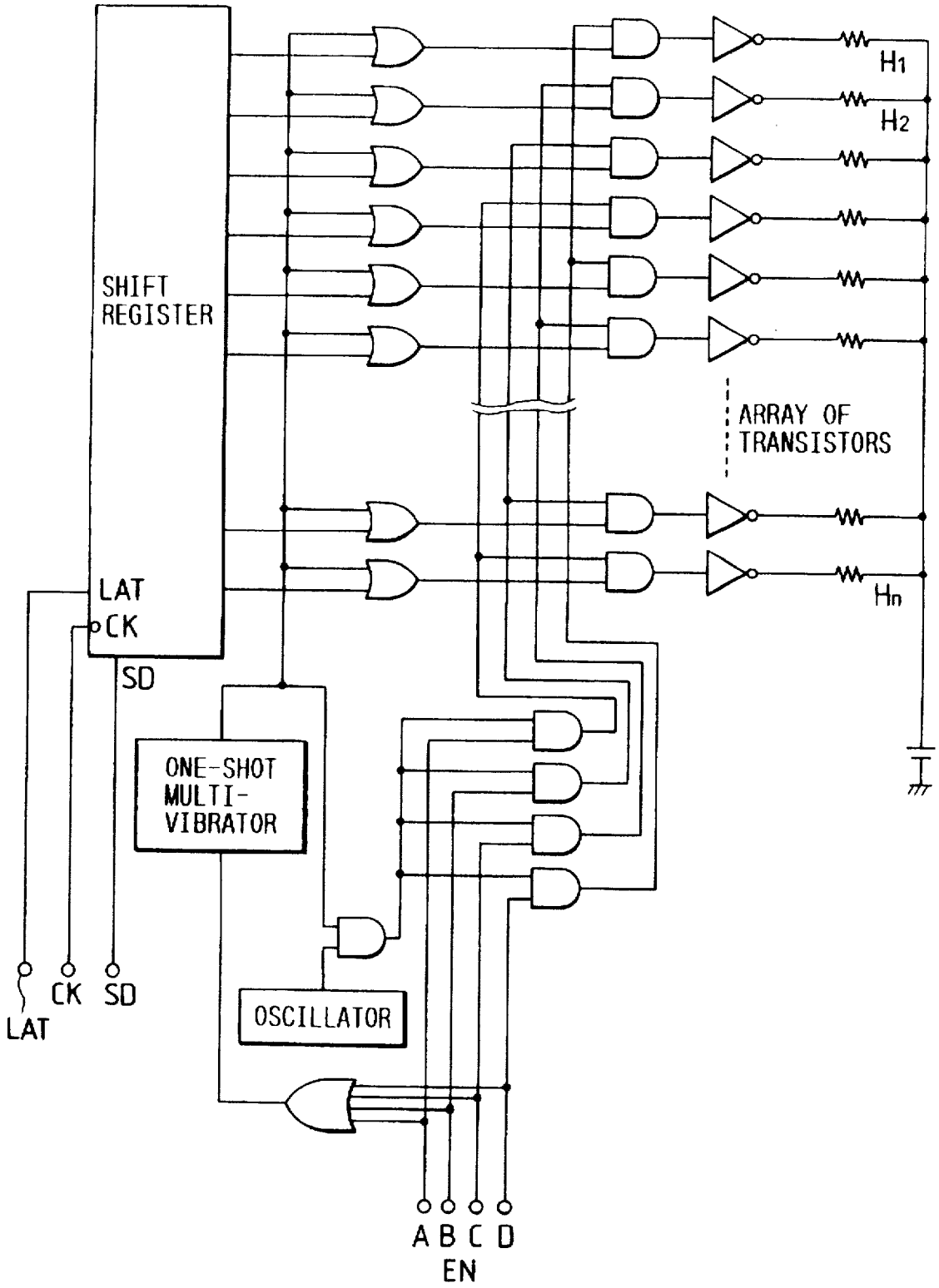
FIG. 10 is a circuit diagram exemplifying a driving circuit used in the third example.

FIG. 10 shows an example of a driving circuit in the example 3 of FIG. 9.

Note that the timing for driving the circuit of FIG. 10 is the same as in the example 1.

In FIGS. 9 and 10, an one-shot multivibrator generates pulses during the time $t_p$ for applying minute pulses as above indicated.

As oscillator can generate rectangular waves having the frequency $w_f$ and duty $w_p/w_f$.

In this example, the oscillator is not synchronized with other parts of the circuit, but can be constituted such that the oscillation is started with the enable signal.

As the driving waveform is made invariant by the synchronization, the ink discharge power is considered to be slightly stabler than in the illustrated example, but there is not almost any influence.

Figure 11:
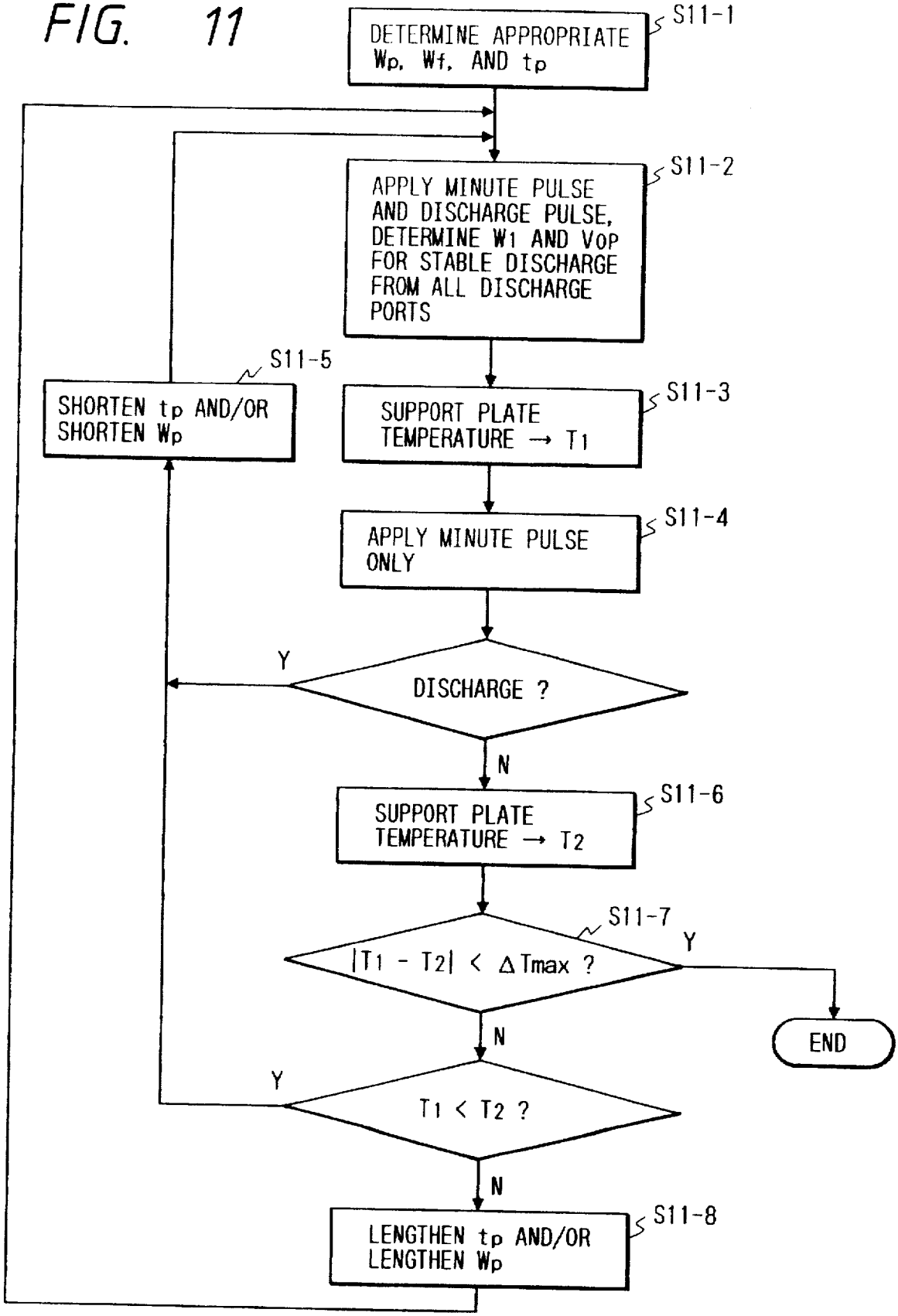
FIG. 11 is a chart illustrating an operation procedures in the third example.

FIG. 11 is a flowchart showing a procedure for determining $V_{OP}$, $w_1$, $t_p$, $w_p$ and $w_f$ in this example.

In FIG. 11, the first step S11-1 is a step of determining appropriately $w_p$, $w_f$ and $t_p$. The criterion is such that $w_p \cdot t_p/w_f$ becomes almost the same as an anticipated w.

The next step S11-2 is a step of determining experimentally $V_{OP}$ and $w_1$ for stable discharge from all discharge ports by applying minute pulses with parameters as defined in S11-1. $V_{OP}$ and $w_1$ are preferably set at their lower limits in a range of stable discharge.

Which of $V_{OP}$ and $w_1$ is to be determined preferentially depends on the conditions of the circuit such as the type of driving transistor.

Next, this stable discharge is continued for a while, and if the temperature on the substrate 106 in the ink jet head reaches a constant value, that constant temperature is set as $T_1$ at step S11-3.

The step S11-4 is a step of applying the minute pulse only to the ink jet head, in which if the ink is discharged through any of discharge ports, the procedure proceeds to step S11-5 where at least one operation of shortening $t_p$, shortening $w_p$ and lengthening $w_f$ is performed.

If the ink is discharged, at step S11-6, the procedure waits until the temperature of support plate reaches a fixed value, and that constant temperature is set as $T_2$.

Next, at step S11-7, $T_1$ and $T_2$ are compared, and if $|T_1-T_2|<\Delta T_{max}$, the procedure of flowchart is terminated. Where $\Delta T_{max}$ is a tolerance for the difference between $T_1$ and $T_2$, and is set to be about 1° to 2° C., like in the example 1.

If $T_1<T_2$, the procedure proceeds to the above step S11-5, where at least one operation of shortening $t_p$, shortening $w_p$ and lengthening $w_f$ is performed.

If $T_1>T_2$, the procedure proceeds to step S11-8 where at least one operation of lengthening $t_p$, lengthening $w_p$ and shortening $w_f$ is performed.

Under the driving conditions defined as above, the test recording was performed in which solid image and blank were repeatedly recorded at intervals of 80 mms, in the same way as the example 1, for the ink jet head.

As a result, the uniform image density could be obtained like in the example 1.

Also, in this example, control means is provided to reduce the temperature variation of the support plate 106, like in the examples 1 and 2, and by controlling the temperature of the support plate to be kept at the temperature when $w_p$, $t_p$, $w_f$, $w_1$ and $V_{OP}$ are determined, the reproducibility of image density can be assured at largely different room temperatures.

In the head driving method of this example, as means for determining the types of driving pulse $w_p$, $t_p$, $w_f$ not dependent upon image signal, the following method can be adopted like in the example 1.

That is, in the state where the above control circuit is operated under the condition of maintaining the room temperature constant, the $w_p$, $t_p$ and $w_f$ can be selected so that the temporal average value of power for making the control as above described when image signal ON is continuously applied to all the heat generating elements is substantially equal to the temporal average value of power when image signal OFF is continuously applied to all the heat generating elements, or more specifically the difference is within 5%.

The advantage of the driving method in this example (example 3) is that the ink is not likely to be discharged when image signal is OFF, and the total amount of power supplied to the head is less than in the example 2.

However, in this example, the driving circuit tends to be complicated.

Example 4

Figure 12:
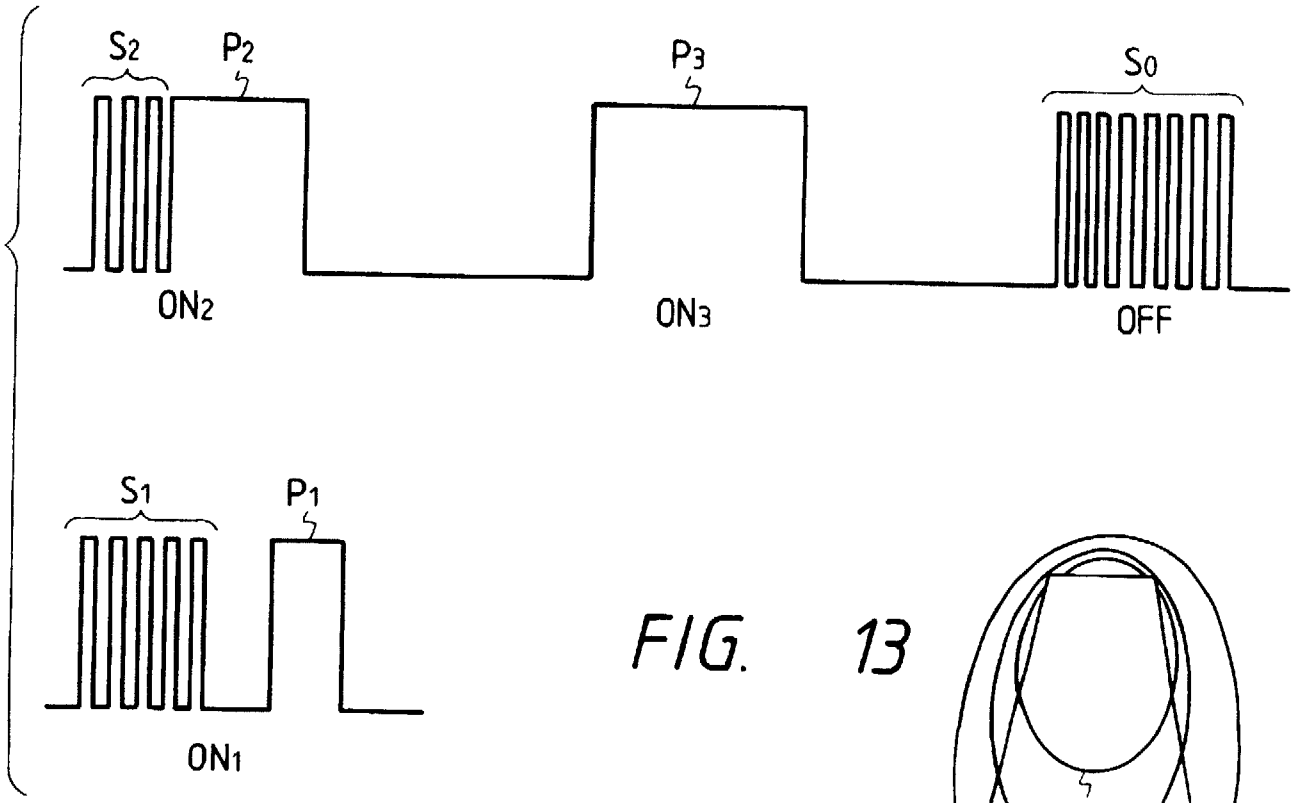
FIG. 12 is a timing chart exemplifying head driving pulses in a fourth example for the driving method of ink jet head according to the present invention.

FIG. 12 is a graph illustrating head driving pulses in the fourth example of the driving method for ink jet head according to the present invention.

The feature of this example is to use an ink jet head capable of four value gradation by changing the width of driving pulse.

In FIG. 12, OFF, $ON_1$, $ON_2$ and $ON_3$ illustrate the shapes of driving pulses at no image signal, level 1, level 2 and level 3, respectively.

$P_1$, $P_2$ and $P_3$ are driving pulses for causing the heat energy in accordance with image signal to be generated, and $S_0$, $S_1$ and $S_2$ are driving pulses for causing the heat energy in accordance with the inverse of image signal to be generated. The subscript indicates the level of signal, which means that the pulse having a greater number causes ink droplets having a larger volume to be discharged.

Figure 13:
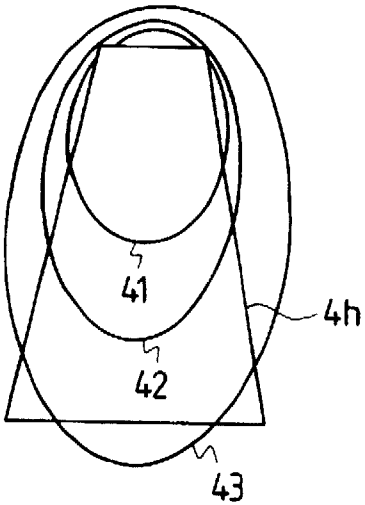
FIG. 13 is a typical view illustrating an head generating element of head used in the fourth example, and some states of producing a bubble.

FIG. 13 is a typical view illustrating schematically the shape of a heat generating element used in this example, and the size of bubble produced when a driving pulse is applied to the heat generating element.

In FIG. 13, $4_h$ shows the shape of a heater (heat generating element), the heater is of trapezoid form, and arranged on the substrate so that the driving voltage is applied between upper and lower bases of the trapezoid.

Numerals 41, 42 and 43 show the shapes of bubbles produced at the image level 1, 2 and 3, respectively, in which if the image level is higher, or the width of driving pulse is greater, the bubble will be gradually produced in wider proportion, and thus becomes larger. As a result, the ink discharge volume becomes larger, with a larger dot being produced on the recording medium.

The constitution of head except for the heater (heat generating element) is the same as in the example 1.

The ink jet head capable of gradient recording can control the stability or reproducibility of image density in a more precise way than the two-value ink jet head used in the examples 1 to 3.

Accordingly, the driving method in this example is especially effective.

FIG. 14 is a view illustrating an example of a circuit for driving in this example (example 4).

In this example, the heat generating elements $H_1$ to $H_n$ are driven sequentially one by one.

Accordingly, the heat generating elements $H_1$ and $H_n$ are driven in a considerable time difference, but the problem that driving timing is shifted can be resolved by arranging the array of discharge ports slightly obliquely relative to a direction orthogonal to that of the relative movement between recording medium and the head.

Figure 14A:
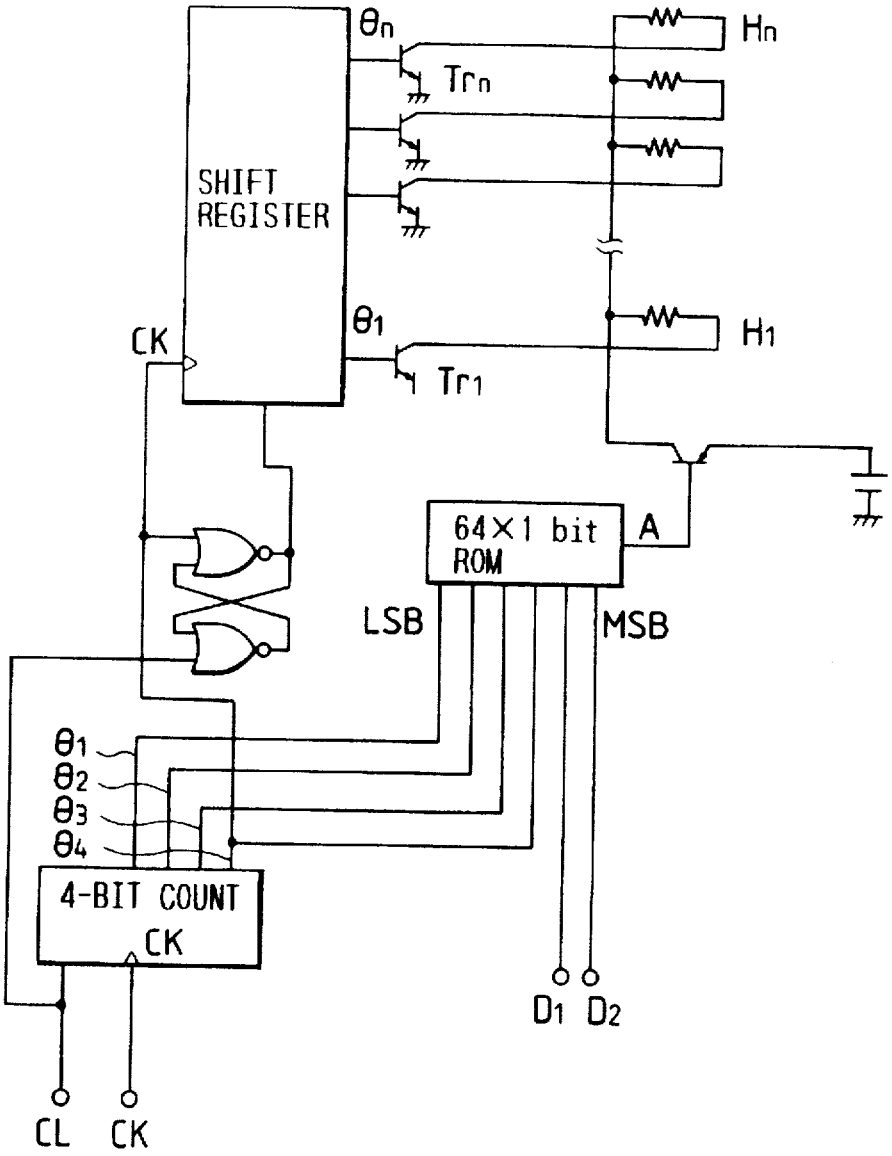
FIG. 14A is a circuit diagram exemplifying a driving circuit used in the fourth example.
Figure 14B:
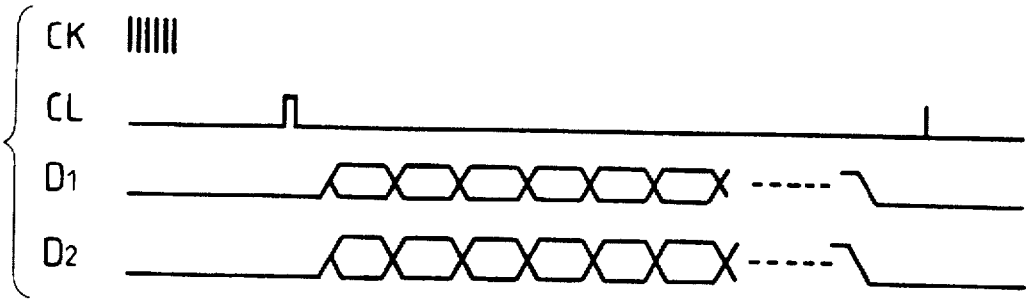
FIG. 14B is a timing chart illustrating actuating signals for the circuit FIG. 14A.

FIG. 14B shows a timing chart for driving the circuit of FIG. 14A.

In FIGS. 14A and 14B, the clock is given a frequency sixteen times the timing for switching the discharge ports for driving.

If a clear pulse is sent to CL beforehand, and then the clock is sent, one of the outputs $Q_1$ to $Q_n$ from a shift register becomes sequentially a high level, and one of $T_{r1}$ to $T_{rn}$ becomes sequentially ON.

In accordance with that, 2-bit image data is sent to $D_1$ and $D_2$.

A 64×1 bit ROM is connected to the output of a 4-bit counter, to the address input of which the above $D_1$ and $D_2$ are connected. By defining the contents of the ROM appropriately, 16 pulses of ON and OFF are sent in accordance with $D_1$ and $D_2$ while one heat generating element is selected, and correspondingly, the heat generating element can be driven.

Figure 15:
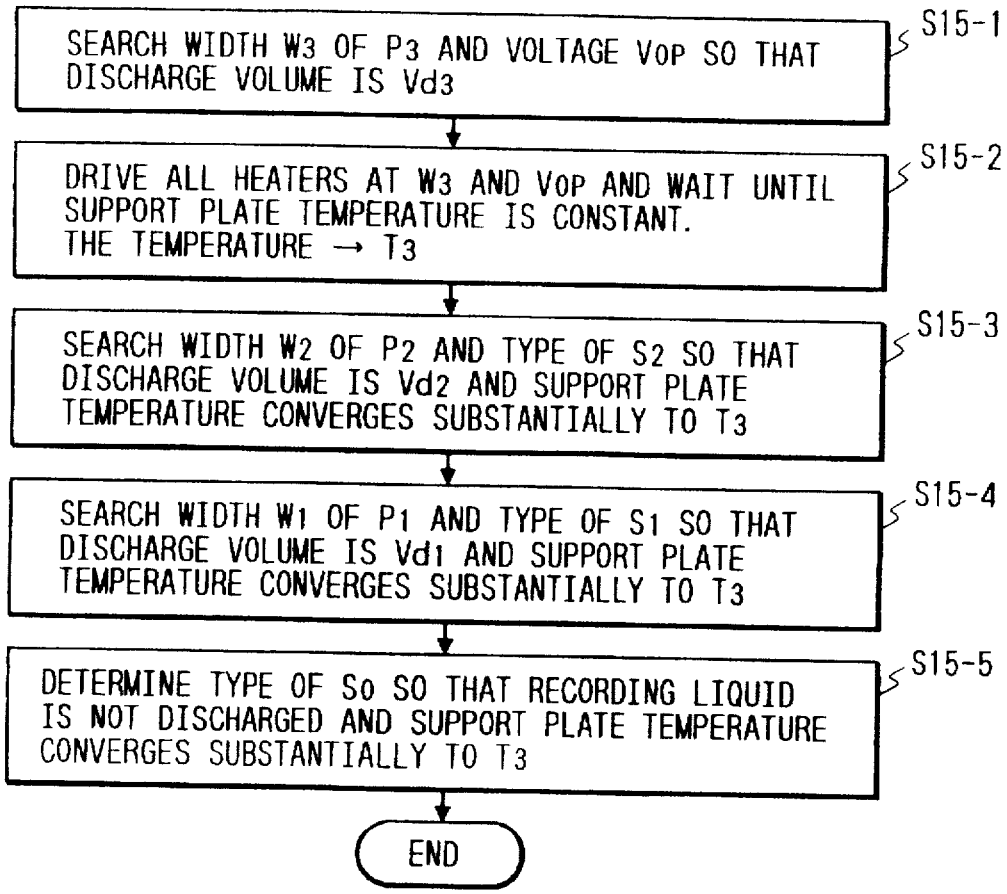
FIG. 15 is a flowchart illustrating an operation procedure in the fourth example.

FIG. 15 is a flowchart showing an example of a procedure for determining the types of $S_0$, $S_1$, $S_2$, $P_1$, $P_2$ and $P_3$ as above described in this example (example 4).

$V_{d1}$, $V_{d2}$ and $V_{d3}$ of FIG. 15 indicate the ink discharge volumes from the head with which desired image densities can be obtained at the image levels 1, 2 and 3, respectively.

In FIG. 15, S15-1 is a step of determining the driving condition at the image level 3. That is, the voltage $V_{OP}$ and the pulse width $w_3$ to be applied to all the heat generating elements are adjusted so that the discharge volume is $V_{d3}$.

At next step S15-2, the procedure waits until the support plate temperature is constant, and sets the value of that temperature as $T_3$.

S15-3 is a step of determining the driving condition at the image level 2. Here, the width $w_2$ of $P_2$ and the type (width, number and frequency of each minute pulse) of $S_2$ are adjusted so that the discharge volume is $V_{d2}$ and the converged value of the support plate temperature is substantially equal to the value $T_3$.

S15-4 is a step of determining the driving condition at the image level 1. Here, the width $w_1$ of $P_1$ and the type (width, number and frequency of each minute pulse) of $S_1$ are adjusted so that the discharge volume is $V_{d1}$ and the converged value of the support plate temperature is substantially equal to the value $T_3$.

S15-5 is a step of determining the type of $S_0$. That is, the width, number and frequency of each minute pulse are determined so that the converged value of the support plate temperature is substantially equal to the value $T_3$.

Note that the ink discharge volume may rely on measuring the consumed amount of ink, or collecting discharged ink in a collector bottle and measuring its weight.

In each step of S15-3, S15-4 and S15-5, a specific criterion that the support plate temperature is substantially equal to $T_3$ is that its difference from $T_3$ is in a range from 1° to 2° C., as the practical decision, although it may depend on the construction of head.

As regards the above procedure of example 4, issuing the pulse to the heat generating elements can be determined uniformly to all the heat generating elements, or separately corresponding to each discharge port with the above procedure while measuring the ink discharge volume through that discharge port. In the latter case, troubles may be taken for setting up, but the dispersion of densities between discharge ports can be reduced.

In this case, $(E_{max}-E)/(V_{max}-V)$ is not only constant except when E is substantially equal to $E_{max}$, but also $(E_3-E_2)/(v_3-v_2)$ and $(E_3-E_1)/(v_3-v_1)$ and $(E_3-E_0)v_3$ are equal and always constant. Where $E_j$ (j=0, 1, 2, 3) represents the total value of the heat energy generated by the heat generating element corresponding to the discharge port, when the image level is j, and $v_j$ (j=1, 2, 3) represents the volume of ink discharged through the discharge port, when the image level is j. Also, the image level 0 represents the image signal OFF.

By setting as above, it is possible to maintain the substrate temperature substantially constant regardless of image signal, due to the same reason as in the example 1, and reduce largely irregularities of image density.

Figure 16:
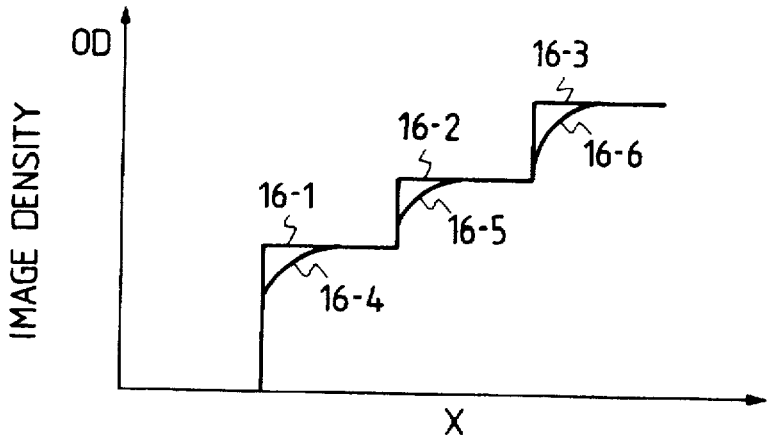
FIG. 16 is a graph illustrating the distribution of image density when the fourth example is applied.

FIG. 16 is a graph illustrating the distribution of density when the head is driven under the driving condition set with the driving method of the above example (example 4).

Under the driving condition of FIG. 16, discharges of each 80 mm, i.e., 500 times, are performed in order of the image levels 0, 1, 2, 3, with a carriage speed of 0.16 m/s, and a discharge interval of 1 millisecond.

In FIG. 16, 16-1, 16-2 and 16-3 show the density distributions at the image levels, 1, 2 and 3, respectively. Also, 16-4, 16-5 and 16-6 show the density distributions at the image levels 1, 2 and 3, respectively, when the driving is performed having no heat energy generated in accordance with the inverse of image signal (conventional example).

As will be clearly seen from FIG. 16, the driving in this example can make the image density more uniform than that of conventional one.

When the gradient control is performed like in this example, it is necessary to reduce irregularities on recording density to an especially small degree.

Accordingly, as described in the examples 1 to 3, by providing control means for reducing the temperature variation of support plate, and with a control circuit, maintaining the temperature of this support plate at the temperature when the type of driving pulse at each image level as previously described has been determined, a more excellent image can be obtained.

Note that in the head driving method of example 4, there is provided a following method as means for determining the type of driving pulse at each image level.

That is, under the condition of constant environmental temperature, and in the state where the control circuit is operated, the temporal average value of power for making the control when the heat energy in accordance with arbitrary image signal level including the case of image signal OFF is continuously applied to all the heat generating elements on the substrate uniformly is made substantially equal to the temporal average value of power for making the control when the heat energy in accordance with image signal different from the image signal level as above indicated is continuously applied to all the heat generating elements uniformly.

Example 5

Figure 17A:
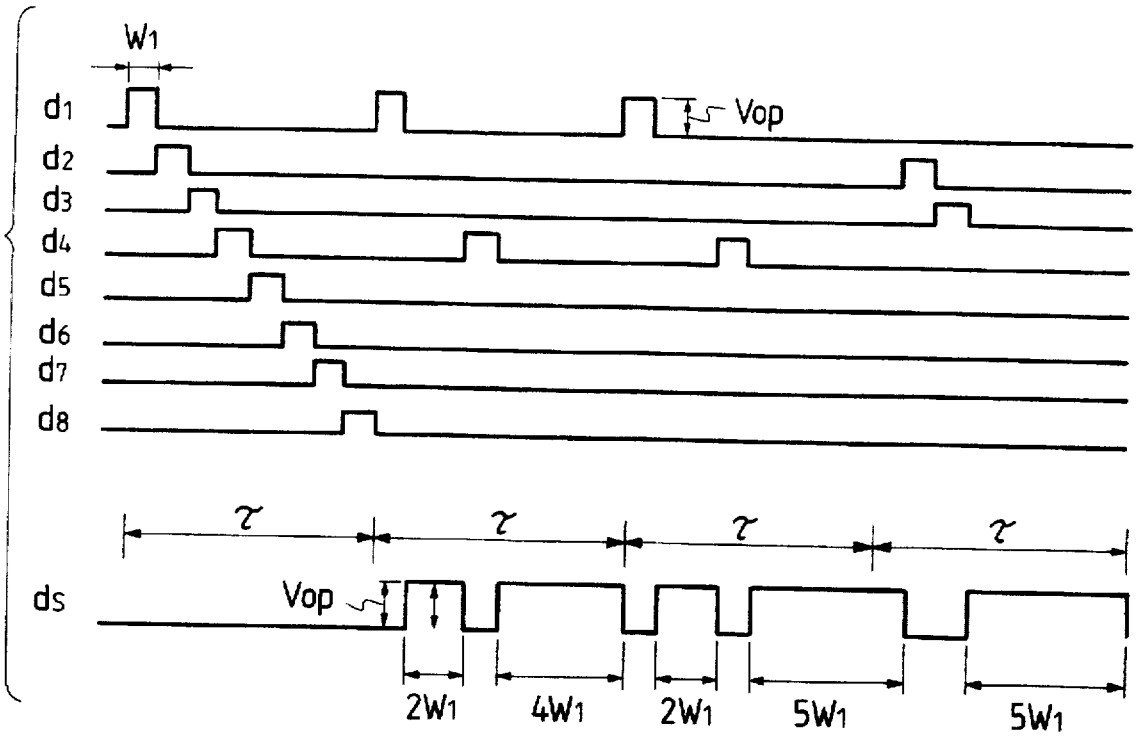
FIG. 17A is a timing chart exemplifying head driving pulses in a fifth example for the driving method of ink jet head according to the present invention.
Figure 17B:
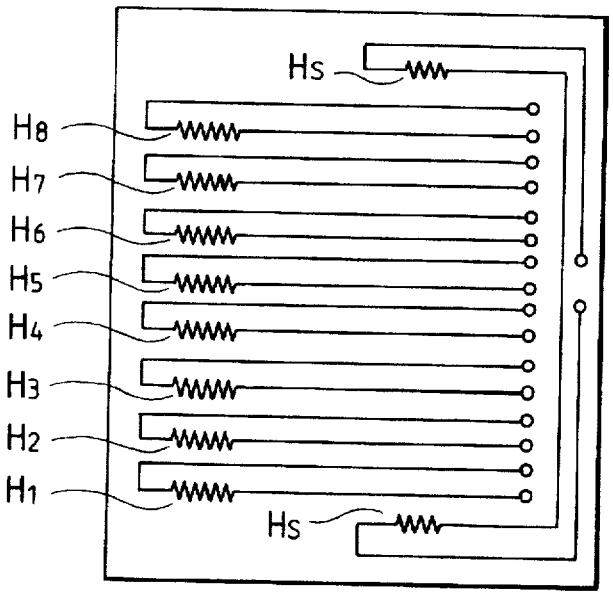
FIG. 17B is a typical view illustrating the arrangement of heat generating elements on the substrate of head used in the fifth example.

FIG. 17A is a timing chart illustrating head driving pulses in the fifth example of the driving method for ink jet head according to the present invention, and FIG. 17B is a typical view illustrating the arrangement of heat generating elements on a substrate of head to which driving pulses are appropriately applied.

The feature of this example is that the heat energy is generated in accordance with the inverse of image signal by heat generating elements on the substrate other than those for discharge.

In FIGS. 17A and 17B, $H_1$ to $H_8$ are heat generating elements for discharge, and $H_S$ is an auxiliary heat generating element for generating the heat energy in accordance with the inverse of the image signal.

An ink jet head for use in this example is substantially the same as that in the example 1, except for the arrangement of heat generating elements on the substrate.

$d_1$ to $d_8$ show driving pulses applied to the heat generating elements $H_1$ to $H_8$, respectively, and $V_{OP}$ is the voltage of driving pulse, $w_1$ is the pulse width, and $\tau$ is the frequency.

$d_s$ shows electrical pulses applied to the auxiliary heat generating element $H_S$ in accordance with the inverse of image signal, the length of that electrical pulse being proportional to the pulse width $w_1$.

It is desirable that the auxiliary heat generating element $H_S$ should be allocated at almost the same distance from all the heat generating elements for discharge $H_1$ to $H_8$.

The $w_1$ and $V_{OP}$ can be determined in a range for stable discharge from each discharge port.

The voltage of electrical pulse is arbitrary, but in this example, it is made the same voltage as $V_{OP}$ in order to simplify the circuit.

Note that the pulse width of the electrical pulse $d_s$ is set to be $nxw_1$ when the number of image signal OFFs is n, based on the pulse width $w_1$.

The method of determining the resistance value for the auxiliary heat generating element $H_S$ is one based on the same concept as in the example 1, assuming that the converged value of the temperature of support plate 106 is $T_1$ when the ink is continuously discharged through all discharge ports for each period $\tau$, and the converged value of the temperature of support plate 106 is $T_2$ when electrical pulses at the same voltage as that for discharge are applied to $H_S$ for each period $\tau$, the resistance value of $H_S$ can be determined so that $T_1$ is substantially equal to $T_2$.

At this time, the tolerance between $T_1$ and $T_2$ is about 1° to 2° C., like in the previous example.

Figure 18A:
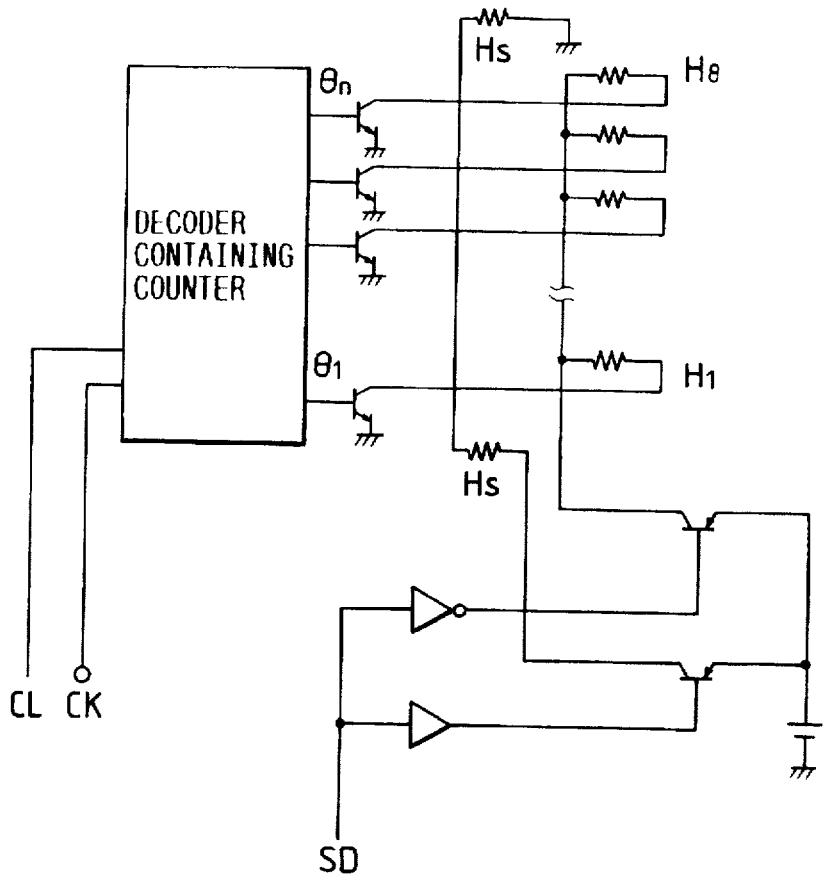
FIG. 18A is a circuit diagram exemplifying a driving circuit used in the fifth example.

FIG. 18A is a view illustrating a circuit configuration for making the driving of head in this example (example 5).

In FIG. 18A, also in this example, like in the previous example 4, the heat generating elements $H_1$ to $H_8$ are driven sequentially one by one.

In this example, instead of the shift register in the circuit of example 4, a decoder containing a counter is used, in which one of the heating quantities $Q_1$ to $Q_8$ for the heat generating elements $H_1$ to $H_8$ is made at high level sequentially, and image data is sent in synchronism with it.

When image data is low, i.e., discharge is not made, an auxiliary heat generating element (heater) $H_S$ is driven.

Figure 18B:
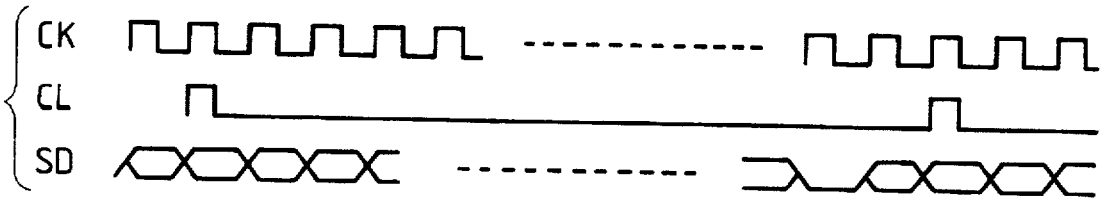
FIG. 18B is a timing chart illustrating actuating signals for the circuit of FIG. 18A.

FIG. 18B is a timing chart illustrating the timing for driving for heat generating element.

As the decoder containing counter in FIG. 18A, for example, a 10-bit type, M74HC4017 (Mitsubishi Electric Corporation) can be used.

The method of driving the head in this example (example 5) has an advantage in that the circuit configuration for driving is made simpler.

However, when the distance between the auxiliary heat generating element $H_S$ and the heat generating elements for discharge $H_1$ to $H_8$ is large, there is a problem that the response characteristic to the variation of temperature due to the switching of ON/OFF of discharge signal is low.

For example, when the distance between the auxiliary heat generating element $H_S$ and the heat generating elements for discharge $H_1$ to $H_8$ is about 5 mm on a Si substrate, it takes about 0.2 seconds for the heat to transfer by a distance of 5 mm on the Si substrate, based on a theory of heat conduction.

Accordingly, when the recording is made by moving the head at a speed of 0.16 m/s, the head is moved about 3 cm during this period, so that the above time of heat conduction is not negligible.

As a result, when the rate of image imprinting is changed abruptly, some irregularities of density may remain.

Also, there is a problem that the heat energy residual on the substrate becomes more or less uneven.

That is, in this example, the total value of heat energy residual on the substrate always becomes constant, but the uneven distribution of heat may arise depending on image pattern.

For example, in FIG. 17B, when the heat generating elements $H_1$ to $H_4$ are ON, and the heat generating elements $H_5$ to $H_8$ are OFF, the residual heat energy on the side of heat generating elements $H_1$ to $H_4$ becomes larger, so that the image density on the side of heat generating elements $H_1$ to $H_4$ becomes slightly higher.

However, according to this example, even with an ink jet head as simply constituted, sufficient effects can be obtained in that by applying a proper amount of auxiliary heat energy in accordance with the inverse of image signal, it is possible to make the temperature distribution uniform, as well as keeping the temperature of substrate 101 constant, so that recording an image without irregularities can be achieved.

Also in this example (example 5), like in the example 1, with the ink jet head mounted on an ink jet recording apparatus as shown in FIG. 4, the recording test of repeating solid image and blank was performed.

In this case, the carriage moving speed and the discharge frequency were made equal to those in the example 1.

Figure 19A:
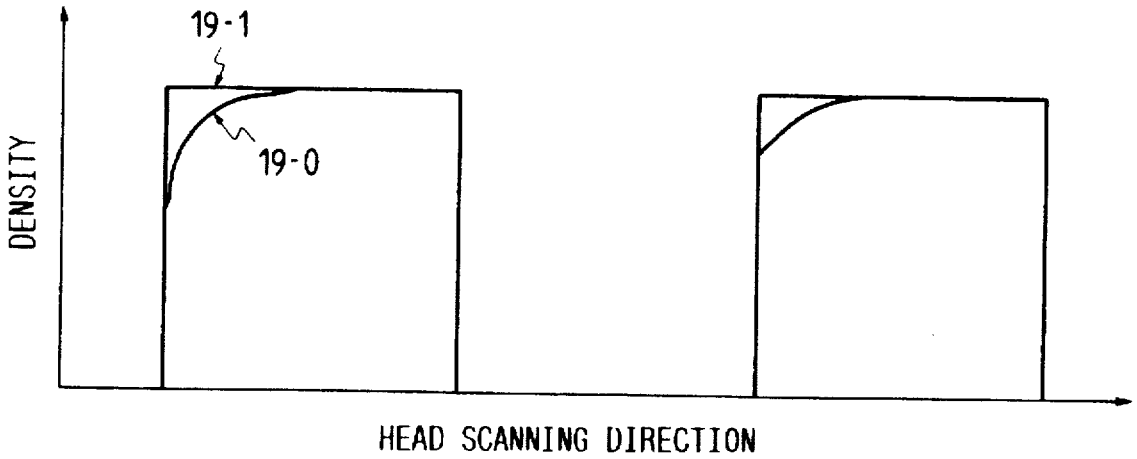
FIG. 19A is a graph illustrating the distribution of image density when the fifth example is applied.

FIG. 19A is a graph illustrating the distribution of density in this case.

In FIG. 19A, 19-0 illustrates the distribution of density when no power is supplied to the auxiliary heat generating element $H_S$, and 19-1 illustrates the distribution of density when electrical pulses are supplied to the auxiliary heat generating element $H_S$ in this example.

With this recording test in this example, owing to the image OFF interval of 80 mm provided like in the example 1, the recording without irregularities on image can be achieved in the same way as in the example 1.

Figure 19B:
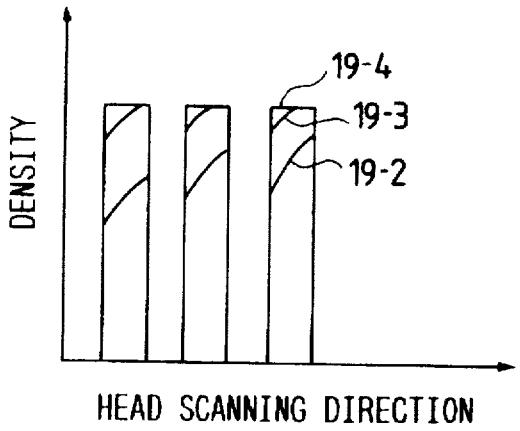
FIG. 19B is a graph illustrating the distribution of image density when the driving condition in the fifth example is changed.

FIG. 19B is a graph illustrating the distribution of density in recording solid image and blank at repetitive intervals (ON-OFF interval of image) the length of which is changed to an interval of 10 mm in the test of FIG. 19A.

In FIG. 19B, 19-2 illustrates the distribution of density when no power is supplied to the auxiliary heat generating element $H_S$, and 19-3 illustrates the distribution of density when electrical pulses are supplied to the auxiliary heat generating element $H_S$ in this example.

Also, in FIG. 19B, 19-4 is illustrated as a reference when image is recorded with the driving method of previous example 1 using the recording head used in the example 1.

As will be clearly seen from the graph of FIG. 19B, if the repetitive interval of solid image and blank is about 10 mm, some irregularities on image may remain due to the previous reason, but it will be found that image is greatly improved as compared with 19-2 of conventional example.

Note that in the driving method of this example, like in the previous example, control means was provided to reduce the temperature variation of support plate, and using a control circuit, keep the temperature of support plate at the temperature when the resistance value of the auxiliary heat generating element $H_S$ was determined, so that more excellent image could be obtained.

Note that in the ink jet head for use in this example, there is provided a following method for determining the resistance value of the auxiliary heat generating element $H_S$.

That is, a method can be adopted for determining the resistance value of the auxiliary heat generating element $H_S$ in such a manner that in the state where the above control circuit is operated under the condition of constant room temperature, the temporal average value of power for making the control when the image signal ON is continuously applied to all the heat generating elements $H_1$ to $H_8$ is made substantially equal to the temporal average value of power for making the control when the image signal OFF is continuously applied to all the heat generating elements $H_1$ to $H_8$, or more specifically, the difference between them is within 5%.

Example 6

Figure 20A:
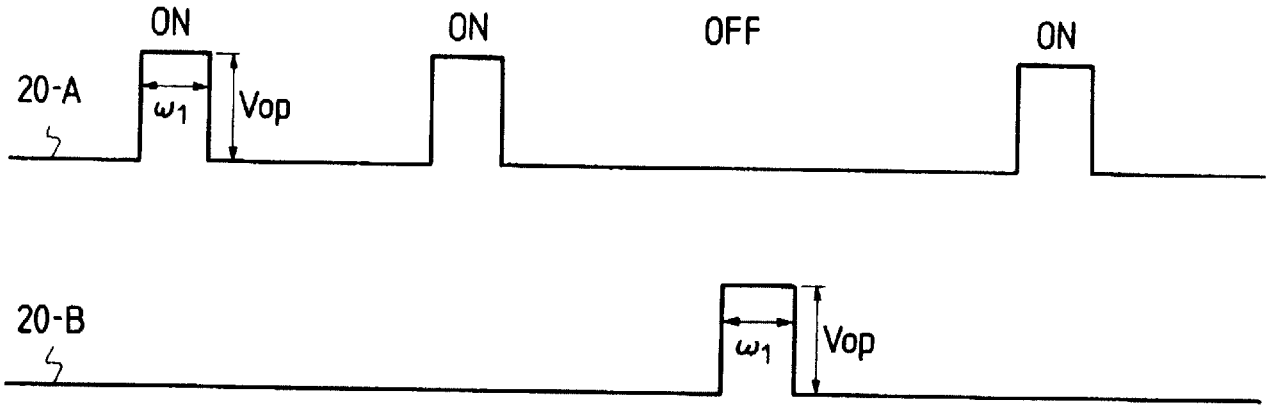
FIG. 20A is a timing chart exemplifying head driving pulses in a sixth example for the driving method of ink jet head according to the present invention.
Figure 20B:
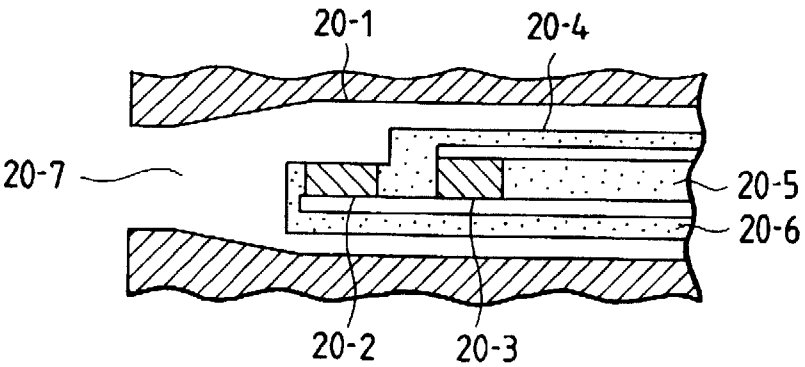
FIG. 20B is a partial longitudinal cross-sectional view illustrating the arrangement of heat generating elements of head used in the sixth example.

FIG. 20A is a timing chart showing driving pulses in the sixth example of the driving method for ink jet head according to the present invention, and FIG. 20B is a partial longitudinal cross-sectional view illustrating the arrangement of heat generating elements within a liquid channel of the ink jet head used in FIG. 20A.

The feature of this example is to drive a recording head having one heat generating element for generating the heat energy in accordance with image signal and one heat generating element for generating in accordance with the inverse of image signal, both of which are arranged in each discharge port.

In FIGS. 20A and 20B, 20-A shows driving pulses dependent upon image signal, and 20-B shows driving pulses dependent upon the inverse of a image signal.

In FIG. 20B, 20-1 is a wall of liquid channel, 20-2 is a heat generating element for generating the heat energy in accordance with image signal, 20-3 is a heat generating element for generating the heat energy in accordance with the inverse of image signal, 20-4 is an electrode common to both heat generating elements, 20-5 is an electrode for supplying the electric power to the heat generating element 20-3, 20-6 is an electrode for supplying the electric power to the heat generating element 20-2, and 20-7 is a discharge port.

Electrical pulses of 20-A are supplied to the heat generating element 20-2, and electrical pulses of 20-B are supplied to the heat generating element 20-3.

The ink jet head used in this example has the same configuration as that used in the example 1, except for portions shown in FIG. 20B.

FIG. 21 is a view illustrating an electrical circuit used in making the driving of head in this example (example 6).

The circuit of FIG. 21 is different from the circuit of example 5 as shown in FIG. 18A in that the quantity of heat generated in the heat generating elements $H_1$ to $H_n$ for discharge is adjusted by the resistance values of the heat generating elements $H_1'$ to $H_n'$ for generating large energy in accordance with the inverse of image signal.

However, the operation of the circuit in this example as shown in FIG. 21 is substantially the same as that in the example 5 as shown in FIG. 18A.

In the ink jet head for use with the driving method of this example, since the heat generating elements $H_1'$ to $H_n'$ for generating the heat energy in accordance with the inverse of the image signal are located farther away from the discharge ports than the heat generating elements $H_1$ to $H_n$ for generating the heat energy in accordance with image signal, it is easy to make a constitution so that the ink is not discharged by driving the heat generating elements $H_1'$ to $H_n'$ for adjustment.

Also, as it is possible to reduce the distance between two types of heat generating elements $H_1$ and $H_n'$ and arrange them closely to each other, the abrupt change of image pattern can be more sufficiently coped with, as compared with the example 5.

Moreover, since these two types of heat generating elements $H_1$ to $H_n$ and $H_1'$ to $H_n'$ can be driven by the driving circuits of separate systems, the degree of freedom in the driving conditions may be increased.

The uniformity of image density in this example was almost the same as in the example 1, so that the substantially equal effects could be obtained.

Also, this example can be achieved using an ink jet head permitting the gradient recording as described with reference to FIG. 13 in the example 4 and having the heat generating elements of trapezoidal shape.

In that case, the heat generating elements $H_1'$ to $H_n'$ for generating the heat energy regardless of image signal may still take the rectangular shape sufficiently.

This example (example 6) has advantages as previously described over other examples, but as the number of electrodes on the substrate is increased with the number of discharge ports, there are some difficulties in dealing with higher density recording.

According to each example as described, it is possible to keep the temperature of the substrate constant and equalize the distribution of temperature without providing temperature detecting means within the substrate 101 or preparing for complex control means, so that the driving method for ink jet head can be obtained in which the high quality, stable recording can be achieved without irregularities on image.

While in the above examples, the present invention was described as being applied to an ink jet recording apparatus of the serial-scan type in which the ink jet head is mounted on the carriage 41, it will be appreciated that the present invention is applicable to an ink jet head of other recording methods, as used for the ink jet recording apparatus of line type of using the ink jet head of line type covering recording area in a paper width direction of recording medium, so that the same effects can be obtained.

Also, the present invention is applicable without regard to the number of ink jet heads mounted on the recording apparatus, for example, when a plurality of ink jet heads are used for the color recording.

The present invention brings about excellent effects particularly in a recording head or a recording device of the bubble jet system proposed by CANON INC. among the various ink jet recording systems.

As to its representative constitution and principle, for example, one practiced by use of the basic principle disclosed in, for example, U.S. Pat. Nos. 4,723,129 and 4,740,796 is preferred.

This system is applicable to either of the so-called on-demand type and the continuous type. Particularly, the case of the on-demand type is effective because, by applying at least one driving signal which gives rapid temperature elevation exceeding nucleate boiling corresponding to the recording information on electro-thermal converters arranged corresponding to the sheets or liquid channels holding a liquid (ink), heat energy is generated at the electro-thermal converters to effect film boiling at the heat acting surface of the recording head, and consequently the bubbles within the liquid (ink) can be formed corresponding one by one to the driving signals.

By discharging the liquid (ink) though an opening for discharging by growth and shrinkage of the bubble, at least one droplet is formed.

By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable.

Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electro-thermal converter (linear liquid channel or right-angled liquid channel) as disclosed in the above-mentioned respective specifications, the constitution by use of U.S. Pat. Nos. 4,558,333, or 4,459,600 disclosing the constitution having the heat acting portion arranged in the flexed region is also included in the present invention.

In addition, the present invention can be also effectively made like the constitution disclosed in Japanese Laid-Open Patent Application No. 59-123670 which disclosed the constitution using a slit common to a plurality of electro-thermal converters as the discharging portion of the electro-thermal converter or Japanese Laid-Open Patent Application No. 59-138461 which discloses the constitution having the opening for absorbing pressure wave of heat energy correspondent to the discharging portion.

Further, as the recording head of the full line type having a length corresponding to the maximum width of a recording medium which can be recorded by the recording device, either the constitution which satisfies its length by a combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or a recording head of the cartridge type integrally provided on the recording head itself.

Also, addition of a restoration means for the recording head, a preliminary auxiliary means, etc. provided as the constitution of the recording device of the present invention is preferable, because the effect of the present invention can be further stabilized.

Specific examples of these may include, for the recording head, capping means, cleaning means, pressurization or suction means, electro-thermal converters or another type of heating elements, or preliminary heating means according to a combination of these, and it is also effective for performing stable recording to perform a preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

Though the ink is considered as the liquid in the examples of the present invention as described above, the present invention is applicable to either of the ink solid or liquefying at room temperature.

With the above ink jet device, as it is common to control the viscosity of ink to be maintained within a certain range for stable discharge by adjusting the temperature of ink in a range from 30° C. to 70° C., the ink as liquefying when a recording enable signal is issued can be used.

In addition, to avoid the temperature elevation due to the heat energy by positively utilizing it as the energy for the change of state from solid to liquid, or prevent the evaporation of ink by using the ink solid in the shelf state, the ink having a property of liquefying only with the application of heat energy to be discharged as liquid ink, such as one liquefying with the application of heat energy in accordance with a recording signal, or already beginning to solidify when reaching a recording medium, is also applicable to the present invention.

In this case, the ink may be in the form of being held in recesses or through holes of porous sheet as liquid or solid matter, and opposed to electro-thermal converters, as described in Japanese Laid-Open Patent Application No. 54-56847 or Japanese Laid-Open Patent Application No. 60-71260.

The most effective method for inks as above described in the present invention is one based on the film boiling as above indicated.

As will be clearly understood from the above description, according to the present invention, there is provided a driving method for an ink jet head comprising one or more discharge ports for discharging the ink, a substrate incorporating one or more heat generating elements for generating the heat energy, each of which is provided correspondent to each discharge port, and a support plate or casing on which said substrate is mounted, the driving method being capable of making the high-quality, stable recording without irregularities on image by equalizing the temperature distribution while maintaining the substrate temperature constant, with a simple construction having no provision of temperature detecting means or complex control means within the substrate, by taking such a constitution that when recording an image with the ink jet head in which the heat energy for discharging the ink in accordance with an image signal is generated in the heat generating elements, and the thermal resistance value passing through the support plate or casing is lower than that not passing through the support plate or casing among the thermal resistance between the substrate and the external, $(E_{max}-E)/(V_{max}-V)$ is controlled to be always substantially constant whenever $E \neq E_{max}$, providing that the thermal energy generated in the substrate is $E_{max}$ when the ink jet head discharges the ink with a maximum volume of $V_{max}$, the ink discharge volume in accordance with the image signal is V, and the heat energy generated in the substrate at this time is E.

We claim:

1. A driving method for an ink jet head comprising one or more discharge ports for discharging ink, a substrate incorporating one or more heat generating elements for generating heat energy, each of which is provided correspondent to one of the discharge ports, and a support plate or casing on which the substrate is mounted, said method comprising the step of:

when recording an image with the ink jet head in which heat energy for discharging the ink in accordance with an image signal is generated in the heat generating elements, setting a level of a drive signal applied to at least one of the heat generating elements for driving the one or more heat generating elements of the ink jet head so as to control $(E_{max}-E)/(V_{max}-V)$ to be always substantially constant whenever $E \neq E_{max}$, providing that thermal energy generated in the substrate is $E_{max}$ when the ink jet head discharges the ink with a maximum volume of $V_{max}$, an ink discharge volume in accordance with the drive signal is V, and the heat energy generated in the substrate at this time is E.

2. A driving method for an ink jet head according to claim 1, characterized in that the heat generating elements generate heat energy in accordance with only an image signal level, including cases where an image signal is zero or OFF, wherein heat energy is generated such that a converged value of temperature on the support plate or casing when heat energy in accordance with an arbitrary image signal level is continuously supplied to all the heat generating elements on the substrate uniformly is substantially equal to a converged value of temperature on the support plate or casing when heat energy in accordance with an image signal having a different image signal level is continuously supplied to all the heat generating elements on the substrate uniformly.

3. A driving method for an ink jet head according to claim 1, wherein a control means is used for reducing a variation of temperature on the support plate or casing.

4. A driving method for an ink jet head according to claim 3, characterized in that the heat generating elements generate heat energy in accordance with only an image signal level, including cases where an image signal is zero or OFF, wherein the heat energy is generated such that when the control means is operated under a condition of constant environmental temperature, a temporal average value of power for control when heat energy in accordance with an arbitrary image signal level continuously supplied to all the heat generating elements on the substrate uniformly is substantially equal to a temporal average value of power when the heat energy in accordance with an image signal having a different image signal level is continuously supplied to all the heat generating elements on the substrate uniformly.

5. A driving method for an ink jet head according to claim 1, characterized in that heat energy generated on the substrate includes energy generated in accordance with the image signal, and energy generated not in accordance with the image signal.

6. A driving method for an ink jet head according to claim 1, characterized in that heat energy generated on the substrate includes energy generated in accordance with the image signal, and energy generated in accordance with an inverse of the image signal.

7. A driving method for an ink jet head according to claim 5 or 6, characterized in that energy generated not in accordance with the image signal, and energy generated in accordance with an inverse of the image signal are generated at a same location as energy generated in accordance with the image signal.

8. A driving method for an ink jet head according to claim 1, characterized in that when an i-th discharge port discharges ink in a largest droplet volume $V_m(i)$, heat energy generated in a corresponding heat generating element is $E_m(i)$, the volume of ink discharged from the i-th discharge port in accordance with an image signal is v(i), and energy generated by the heat generating element at that time is e(i), $(E_m(i)-e(i))/(V_m(i)-v(i))$ is controlled to be always substantially constant such that $e(i) \neq E_m(i)$.

9. A driving method for an ink jet head according to claim 5 or 6, characterized in that heat energy generated not in accordance with the image signal, or heat energy generated in accordance with an inverse of the image signal depends on a steady current flow which is smaller than a current to be applied in accordance with the image signal.

10. A driving method for an ink jet head according to claim 5 or 6, characterized in that heat energy generated not in accordance with the image signal, or heat energy generated in accordance with an inverse of the image signal depends on plural pulses having smaller widths than that of current to be applied in accordance with the image signal.

11. A driving method for an ink jet head according to claim 5 or 6, characterized in that heat energy generated not in accordance with the image signal, or heat energy generated in accordance with an inverse of the image signal depends on electric pulses having a width which is not large enough to discharge the ink.

12. A driving method for an ink jet head according to claim 1, characterized in that the ink jet head comprises a recording head for discharging the ink by the use of heat energy, and includes electrothermal converters for generating the heat energy.

13. A driving method for an ink jet head according to claim 1, characterized in that the ink jet head discharges the ink through the discharge ports by growth of bubbles due to film boiling caused by the heat energy applied by the electro-thermal converters.

14. A driving method for an ink jet head according to claim 7, characterized in that heat energy generated not in accordance with the image signal, or heat energy generated in accordance with an inverse of the image signal depends on a steady current flow which is smaller than a current to be applied in accordance with the image signal.

15. A driving method for an ink jet head according to claim 7, characterized in that heat energy generated not in accordance with the image signal, or heat energy generated in accordance with an inverse of the image signal depends on plural pulses having smaller widths than that of current to be applied in accordance with the image signal.

16. A driving method for an ink jet head according to claim 7, characterized in that heat energy generated not in accordance with the image signal, or heat energy generated in accordance with an inverse of the image signal depends on electric pulses having a width which is not large enough to discharge the ink.

17. A method for driving an ink jet head having a discharge port for discharging an ink, said head discharging said ink from said discharge port by applying heat energy to said ink, said method comprising the steps of:

driving the ink jet head by supplying a first driving signal for generating a first heat energy for discharging the ink to a heat generating means corresponding to a discharge port used for discharging the ink and supplying a second driving signal for generating a second heat energy having a range insufficient for discharging the ink to a heat generating means corresponding to a discharge port not used for discharging the ink in accordance with a recording signal, said supplying of said second driving signal occurring with a substantially same timing as when recording is performed by the heat generating means, wherein said first and said second driving signals are set so that a heat energy remaining in said ink jet head of the heat energy generated by said heat energy generating means by said first driving signal is substantially equal to the heat energy remaining in said ink jet head of the heat energy generated by said heat energy generating means by said second driving signal, and wherein each of the first driving signal and the second driving signal are a pulse having a width corresponding to a thermal energy generated by each said signal.

18. A method according to claim 17, characterized in that said ink jet head causes a state variation in said ink by heating so as to discharge said ink because of pressure caused by the state variation.

19. An apparatus according to claim 17, wherein said first and said second drive signals are signals each having a different current value.

20. An apparatus according to claim 17, wherein said first and said second drive signals are signals each having a different voltage value.

21. An apparatus according to claim 17, wherein said first and said second drive signals are signals each having a different pulse width.

22. An apparatus according to claim 17, wherein said second drive signal comprises a plurality of fine width signals.

23. A driving method for an ink jet head according to claim 17, characterized in that when an i-th discharge port discharges ink in a largest droplet volume $V_m(i)$, heat energy generated in a corresponding heat generating element is $E_m(i)$, the volume of ink discharged from the i-th discharge port in accordance with an image signal is v(i), and energy generated by the heat generating element at that time is e(i), $(E_m(i)-e(i))/(V_m(i)-v(i))$ is controlled to be always substantially constant such that $e(i)\neq E_m(i)$.

24. A driving method for an ink jet head according to claim 17, characterized in that the ink jet head comprises a recording head for discharging the ink by the use of heat energy, and includes a plurality of electrothermal converters for generating the h eat energy.

25. A driving method for an ink jet head according to claim 17, characterized in that the ink jet head discharges the ink through the discharge ports by growth of bubbles due to film boiling caused by the heat energy applied by at least one electro-thermal converter.

26. A driving apparatus for an ink jet head having a plurality of discharge ports for discharging an ink, and a plurality of heat generating means for generating heat energy to discharge the ink, each said heat generating means corresponding to an associated discharge port, said ink jet head comprising a substrate on which said heat generating means are mounted, and one of a support plate and a casing to which said substrate is attached, said apparatus comprising:

driving means for driving said ink jet head by applying a first drive signal for generating a heat energy for discharging the ink to said heat generating means corresponding to a given discharge port for discharging the ink in accordance with a record signal, and applying a second drive signal for generating a heat energy which is within a range insufficient to discharge the ink, to said heat generating means corresponding to a given discharge port not discharging ink, wherein said first and said second drive signals are set such that a heat energy remaining in the head from the heat energy generated by said heat generating means in response to said first drive signal is substantially equal to a heat energy remaining in said head as a result of the heat energy generated in response to said second drive signal, and wherein a thermal resistance value for heat passing through the support plate or casing is lower than a thermal resistance value for heat not passing through the support plate or casing among thermal resistance values between the substrate and externally of the ink jet head.

27. An apparatus according to claim 26, further comprising control means for controlling and reducing a temperature variation of the support plate or casing.

28. An apparatus according to claim 26, wherein said first and said second drive signals are signals each having a different current value.

29. An apparatus according to claim 26, wherein said first and said second drive signals are signals each having a different voltage value.

30. An apparatus according to claim 26, wherein said first and said second drive signals are signals each having a different pulse width.

31. An apparatus according to claim 26, wherein said second drive signal comprises a plurality of fine width signals.

32. An apparatus according to claim 26, wherein said ink jet head causes a state variation including a bubble formation in the ink by heating so as to discharge the ink by pressure due to the state variation.

33. A driving apparatus for an ink jet head having a discharge port for discharging an ink, and discharging means for discharging the ink provided in correspondence with the discharge port and for generating a heat energy to discharge the ink from said discharge port, said apparatus comprising:

driving means for driving said ink jet head by supplying a first driving signal for generating thermal energy for discharging the ink in accordance with a gradation exhibited by a recording signal to a heat generating means and supplying a second driving signal for generating thermal energy which is within a range insufficient to discharge the ink to a heat generating means in accordance with gradation exhibited by said recording signal, in response to the recording signal exhibiting the gradation including nondischarge of ink, supplying of said second driving signal occurring with a same timing as when recording is performed by the heat generating means, wherein said first and said second driving signals are set such that a heat energy remaining in the ink jet head of the heat energy generated by said heat generating means by said first and said second drive signals regardless of the recording signal is maintained substantially constant regardless of the gradation exhibited by the recording signal, and wherein each of the first driving signal and the second driving signal are a pulse having a width corresponding to a thermal energy generated by each said signal.

34. An apparatus according to claim 33, characterized in that said second drive signal comprises a signal having a plurality of fine widths, and wherein a number of said fine width signals differs depending on said gradation indicated by said record signal.

35. An apparatus according to claim 33, wherein said ink jet head causes a state variation including a bubble formation in the ink by heating so as to discharge the ink by pressure due to the state variation.

36. A driving apparatus for an ink jet head having at least one of a discharge port for discharging an ink, and discharging means for discharging the ink provided correspondent to the discharge port and generating heat energy so as to discharge the ink from said discharge port, said apparatus comprising:

auxiliary heat generating means for generating heat energy provided in correspondence with each said discharge port of said recording head; and driving means for driving said ink jet head by applying to said discharging means, in accordance with a record signal, a first driving signal for generating heat energy causing ink discharge from said discharge port used for ink discharge and by applying, in accordance with a signal opposite to the record signal, a second driving signal for generating heat energy within a range which is insufficient to discharge the ink to said auxiliary heat generating means, said supplying of said second driving signal occurring with a same timing as when the ink is discharged from the discharge port, wherein said driving means drives said auxiliary heat generating means such that a heat energy remaining in the head by said auxiliary heat generating means in accordance with said second driving signal is substantially equal to a heat energy remaining in said head after discharging the ink by said discharge means in accordance with said first driving signal, and wherein the second driving signal is a pulse having a width corresponding to a thermal energy generated.

37. An apparatus according to claim 36, wherein said ink jet head causes a state variation in the ink by heating so as to discharge the ink by pressure due to the state variation.

38. A driving apparatus for an ink jet head having a discharge port for discharging an ink and discharging means for discharging the ink provided correspondent to the discharge port and for generating a heat energy to discharge the ink from said discharge port, said apparatus comprising:

auxiliary heat generating means for generating heat energy provided in correspondence with said discharge port;

driving means for driving said discharging means and said auxiliary heat generating means by applying, in accordance with a recording signal, a first signal to said discharging means corresponding to said discharge port for discharging the ink so as to cause discharge of the ink and by applying a second signal for generating heat energy insufficient to cause said discharging means corresponding to said discharge port to discharge the ink, said supplying of said second driving signal occurring with a same timing as when the ink is discharged from the discharge port, wherein said first and said second driving signals are set so that a heat energy remaining in the ink jet head of the heat energy generated by said heat energy generating means by said first and said second driving signals regardless of the recording signal is maintained substantially constant, and wherein the second driving signal is a pulse having a width corresponding to a thermal energy generated.

39. An apparatus according to claim 38, wherein said ink jet head causes a state variation in the ink by heating so as to discharge the ink by pressure due to the state variation.

40. An ink jet recording apparatus having a recording head provided with a plurality of discharge ports for discharging an ink, said apparatus comprising:

first heat generating means for generating heat energy to discharge the ink from the discharge ports, said first heat generating means being provided correspondent to the discharge ports;

second heat generating means for generating heat energy having a range insufficient to discharge the ink from the discharge ports, said second heat generating means being provided correspondent to the discharge ports; and driving means for driving a one of said first heat generating means and said second heat generating means at a timing for recording, wherein a thermal energy generated by said second heat generating means and supplied to said recording head is substantially equal to a thermal energy remaining in said recording head after discharging the ink as a result of thermal energy generated by said first heat generating means.

41. A method for driving an ink jet head having a discharge port for discharging an ink, said head discharging said ink from said discharge port by applying heat energy to said ink, said method comprising the steps of:

applying a first heat energy to said ink, causing said ink to be discharged; and applying a second heat energy to said ink, said second heat energy being within a range insufficient to discharge the ink, wherein an amount of heat energy which is applied to said head by said second heat energy is substantially equal to a heat energy remaining in said head after said ink is discharged in response to said generating of said first heat energy, wherein the heat energy is generated in accordance with only an image signal level, including cases where an image signal is zero or OFF, and wherein the heat energy is generated such that a converged value of temperature on the support plate or casing when the heat energy in accordance with an arbitrary image signal level is continuously supplied to all of a plurality of heat generating elements on a substrate uniformly is substantially equal to a converged value of temperature on a support plate or a casing when the heat energy in accordance with an image signal having a different image signal level is continuously supplied to all the heat generating elements on the substrate uniformly.

42. An apparatus according to claim 41, wherein said ink jet head causes a state variation including a bubble formation in the ink by heating so as to discharge the ink by pressure due to the state variation.

43. A method for driving an ink jet head having at least one of a support plate and a casing, and a discharge port for discharging an ink, a substrate, and a plurality of heat generating elements disposed thereon, said head discharging said ink from said discharge port by applying heat energy to said ink, said method comprising the steps of:

applying a first heat energy to said ink, causing said ink to be discharged;

applying a second heat energy to said ink, said second heat energy being within a range insufficient to discharge the ink; and using a control means for controlling said applying of said first heat energy and said applying of said second heat energy in order to reduce a variation of temperature on at least one of a support plate and a casing, wherein an amount of heat energy which is applied to said head by said second heat energy is substantially equal to a heat energy remaining in said head after said ink is discharged in response to said generating of said first heat energy, and wherein the heat generating elements generate heat energy in accordance with only an image signal level, including cases where an image signal is zero or OFF, wherein the heat energy is generated such that when the control means is operated under a condition of constant environmental temperature, a temporal average value of power for control when the heat energy in accordance with an arbitrary image signal level continuously supplied to all the heat generating elements on the substrate uniformly is substantially equal to a temporal average value of power when the heat energy in accordance with an image signal having a different image signal level is continuously supplied to all the heat generating elements on the substrate uniformly.

44. An apparatus according to claim 43, wherein said ink jet head causes a state variation including a bubble formation in the ink by heating so as to discharge the ink by pressure due to the state variation.

45. A method for driving an ink jet head having a discharge port for discharging an ink and a substrate, said head discharging said ink from said discharge port by applying heat energy to said ink according to an image signal, said method comprising the steps of:

applying a first heat energy for discharging said ink to said ink in a discharge port which is performing ink discharging, and applying a second heat energy to said ink in a discharge port which is not performing ink discharging, said second heat energy being within a range insufficient to discharge the ink, wherein an amount of heat energy which is applied to said head by said second heat energy is substantially equal to a heat energy remaining in said head after said ink is discharged in response to said generating of said first heat energy, wherein the heat energy generated on a substrate includes energy generated in accordance with the image signal, and energy generated not in accordance with the image signal, and wherein each of the first driving signal and the second driving signal are a pulse having a signal width corresponding to said heat energy generated by each said signal, and wherein the energy generated not in accordance with the image signal is provided by electric pulses having widths which are not large enough to discharge the ink.

46. A driving method for an ink jet head according to claim 45, wherein the energy generated not in accordance with the image signal is generated at a same location as the energy generated in accordance with the image signal.

47. A driving method for an ink jet head according to claim 46, wherein the heat energy generated not in accordance with the image signal depends on a steady current flow which is smaller than a current to be applied in accordance with the image signal.

48. A driving method for an ink jet head according to claim 46, wherein the heat energy generated not in accordance with the image signal depends on plural pulses having smaller widths than those widths of current to be applied in accordance with the image signal.

49. A driving method for an ink jet head according to claim 46, wherein the heat energy generated not in accordance with the image signal depends on electric pulses having a width which is not large enough to discharge the ink.

50. A driving method for an ink jet head according to claim 45, wherein the heat energy generated not in accordance with the image signal depends on plural pulses having smaller widths than those widths of current to be applied in accordance with the image signal.

51. A driving method for an ink jet head according to claim 45, wherein the energy generated not in accordance with the image signal is generated in accordance with an inverse of the image signal.

* * * * *

UNITED STATES PATENT AND TRADEMARK OFFICE

CERTIFICATE OF CORRECTION

PATENT NO. : 5,798,772

DATED : August 25, 1998

INVENTOR(S) : MASAYOSHI TACHIHARA, ET AL.

It is certified that error appears in the above-identified patent and that said Letters Patent is hereby corrected as shown below:

On the title page,: item

[54], TITLE

"METHOD" should read --METHOD FOR--.

[57], ABSTRACT

Line 11, "said" should read --the--; and
Line 15, "apparatus" should read --apparatus,--.

COLUMN 1

Line 1, "METHOD" should read --METHOD FOR--.

COLUMN 2

Line 13, "rise" should read --rises,--;
Line 32, "No. 63-116875" should read --No. 63-116857--; and
Line 62, "can not" should read --cannot--.

COLUMN 5

Line 52, "procedures" should read --procedure--; and
Line 57, "an" should read --a--.

UNITED STATES PATENT AND TRADEMARK OFFICE

CERTIFICATE OF CORRECTION

PATENT NO. : 5,798,772

DATED : August 25, 1998

INVENTOR(S) : MASAYOSHI TACHIHARA, ET AL.

It is certified that error appears in the above-identified patent and that said Letters Patent is hereby corrected as shown below:

COLUMN 7

Line 27, "$S_1'$=1500 mm" should read --$S_1'$=1500 $mm^2$--

COLUMN 12

Line 39, "Where" should read --where--.

COLUMN 13

Line 40, "As" should read --An--.
Line 54, "w." should read --$w_1$.--.

COLUMN 14

Line 24, "as" should read --as in--.

COLUMN 15

Line 18, "proportion," should read --proportions,--.

UNITED STATES PATENT AND TRADEMARK OFFICE

CERTIFICATE OF CORRECTION

PATENT NO. : 5,798,772

DATED : August 25, 1998

INVENTOR(S) : MASAYOSHI TACHIHARA, ET AL.

It is certified that error appears in the above-identified patent and that said Letters Patent is hereby corrected as shown below:

COLUMN 20

Line 9, "a" should read --an--.
Line 10, "of" should read --of a--.

COLUMN 22

Line 1, "the con-" should be deleted.
Line 2, "stitution" should be deleted.

COLUMN 26

Line 6, "h eat" should read --heat--.

COLUMN 27

Line 67, "ink" should read --ink,--.

Signed and Sealed this

Third Day of August, 1999

*Attest:*

*Attesting Officer*

Q. TODD DICKINSON

*Acting Commissioner of Patents and Trademarks*